US011067237B2

(12) United States Patent
Angelotti

(10) Patent No.: US 11,067,237 B2
(45) Date of Patent: Jul. 20, 2021

(54) RESONATOR GENERATING A SIMULATED FLAME

(71) Applicant: Philip Angelotti, Chandler, AZ (US)

(72) Inventor: Philip Angelotti, Chandler, AZ (US)

( * ) Notice: Subject to any disclaimer, the term of this patent is extended or adjusted under 35 U.S.C. 154(b) by 87 days.

(21) Appl. No.: 16/412,051

(22) Filed: May 14, 2019

(65) Prior Publication Data

US 2019/0293250 A1 Sep. 26, 2019

Related U.S. Application Data

(63) Continuation-in-part of application No. 16/122,748, filed on Sep. 5, 2018, now Pat. No. 10,309,599, and a continuation-in-part of application No. PCT/US2017/036862, filed on Jun. 9, 2017, which is a continuation of application No. 15/179,706, filed on Jun. 10, 2016, now Pat. No. 9,568,157.

(60) Provisional application No. 62/555,051, filed on Sep. 7, 2017, provisional application No. 62/554,419, filed on Sep. 5, 2017, provisional application No. 62/173,809, filed on Jun. 10, 2015.

(51) Int. Cl.

| | |
|---|---|
| ***F21S 10/04*** | (2006.01) |
| ***B01F 3/04*** | (2006.01) |
| ***B05B 17/06*** | (2006.01) |
| ***B05B 17/00*** | (2006.01) |

(52) U.S. Cl.

CPC ..... *F21S 10/04* (2013.01); *B01F 3/0407* (2013.01); *B05B 17/0607* (2013.01); *B05B 17/0615* (2013.01); *B05B 17/0646* (2013.01); *B05B 17/0684* (2013.01)

(58) Field of Classification Search

CPC .... F21S 10/04; B01F 3/0407; B05B 17/0607; B05B 17/0615; B05B 17/0646; B05B 17/0684

USPC ..... 261/26, 30, 81, 107; 362/96

See application file for complete search history.

(56) References Cited

U.S. PATENT DOCUMENTS

2014/0312136 A1* 10/2014 Kubicek ..... B05B 17/0615 239/8
2017/0182200 A1 6/2017 McCavit et al.
2018/0161471 A1 6/2018 Davis et al.
(Continued)

OTHER PUBLICATIONS

PCT; International Search Report & Written Opinion dated Aug. 12, 2020 in PCT Application No. US2020/032757.

*Primary Examiner* — Robert A Hopkins
(74) *Attorney, Agent, or Firm* — Snell & Wilmer L.L.P.

(57) ABSTRACT

An artificial flame apparatus produces a simulated flame using a plume of mist that is illuminated around, about, and/or through an artificial wick. A mist may be produced by a transducer, such as an ultrasonic transducer, that is in contact with liquid from a liquid reservoir. The rate of mist exiting the housing may be modulated to produce a more realistic looking artificial flame. An airflow device may control, shape, vary, and/or move the mist in the creation of the vapor plume. Airflow channels, inlet and outlet ports, openings (angled and/or straight) to effectively transport air to control movement and/or shape plume characteristics (e.g. height, width, density, shape) to simulate the look and effect of a realistic dancing flame. A light source is configured to illuminate the mist and/or the artificial wick.

41 Claims, 14 Drawing Sheets

(56) References Cited

U.S. PATENT DOCUMENTS

| | | | |
|---|---|---|---|
| 2019/0003670 | A1 | 1/2019 | Angelotti |
| 2019/0128490 | A1 | 5/2019 | Boucher et al. |

* cited by examiner

RESONATOR GENERATING A SIMULATED FLAME

CROSS REFERENCE TO RELATED APPLICATIONS

This application is a continuation in part of U.S. patent application Ser. No. 16/122,748, which is a continuation in part of PCT patent application no. PCT/US2017/036862, having an international filing date of Jun. 9, 2017 and claiming the benefit of U.S. patent application Ser. No. 15/179,706, filed on Jun. 10, 2016 and now issued as U.S. Pat. No. 9,568,157 on Feb. 14, 2017; and this application claims the benefit of priority to U.S. provisional patent application No. 62/555,051, filed on Sep. 7, 2017, to U.S. provisional patent application No. 62/554,419, filed on Sep. 5, 2017, and to U.S. provisional patent application No. 62/173,809, filed on Jun. 10, 2015; the entirety of all applications are hereby incorporated by reference herein.

BACKGROUND

Field of the Invention

This disclosure is generally directed to the creation of an imitation flame for use in non-flammable candles as well as numerous other applications.

Background

Simulated flames in candles are desirable for use in enclosed spaces where a real flame is undesirable, impractical or not permitted. There are different ways to generate simulated flames, and some simulated flames are more realistic than others. Creating a cost effective and compact simulated flame is desirable for many applications in both homes and commercial environments.

SUMMARY

Some embodiments of the disclosure are directed to an apparatus having a transducer configured to transduce a liquid to form a simulated flame. The apparatus may utilize fluid mechanics, fluid dynamics, aerodynamics, and hydrodynamics to create, shape and control the transduced liquid. In some embodiments, the transducer may be an oscillation and/or vibration device. In some embodiments, the transducer may be a piezoelectric transducer driven by a drive signal such that a liquid transduces to a mist, vapor, or aerosol. The transducer may be submerged within the liquid reservoir. A wick or a dispenser may be another means of presenting the liquid to the transducer. The apparatus may utilize an airflow device to control, shape, vary, and/or move the vapor mist to create a vapor plume. Use of a nozzle/manifold a certain distance above the transducer may shape the mist as well. The apparatus may consist of multiple airflow channels, inlet and outlet ports, openings (angled and/or straight) to effectively transport air to control movement and/or shape plume characteristics (e.g. height, width, density, shape) to simulate the look and effect of a dancing flame. In embodiments, the air flow channels are located anywhere on the housing. In embodiments, the airflow channels are located anywhere in the housing. In embodiments, the airflow channels are at the top of the housing. The vapor plume is illuminated by a colored light source to generate a realistic simulated flame. The colored light source may be proximal to, located within and/or about the vapor plume.

In embodiments, the airflow channels disperse portions of the mist, resulting in the appearance of a more realistic flame. In embodiments, the vapor plume is illuminated by a colored light source to generate a realistic simulated flame. The colored light source may be proximal to, located within, and/or about the vapor plume. In embodiments, the colored light source comprises any one or more colors in the visible spectrum (430-770 THz).

In embodiments, the airflow channels are capable of moving air in a vortex around the vapor plume, which causes the vapor plume to swirl. In embodiments, the airflow channels are directed to move air to the apex of the vapor plume, which disseminates the mist and results in shaping the vapor plume.

An exemplary artificial flame apparatus utilizes a mist plume that is illuminated by a light source to imitate a flame. In an exemplary embodiment, the mist exits a housing around an artificial wick. The artificial wick may be shaped like a conventional wick or have a flame shape, such as a silhouette of a flame. The artificial wick may comprise a light source such as a light emitting diode, fiber optics or light tubes, for example. An exemplary artificial wick comprises a plurality of individual light sources or elements, such as LEDs, fiber optics or light tubes that are configured to imitate a wick of a candle and/or a flame. A plurality of fiber optics or light tubes may be spiraled about each other for example and an individual light source may emit a different color light from one of the other light sources. In addition, the light intensity or color may change to produce a more realistic artificial flame appearance.

In embodiments, the artificial flame apparatus comprises one or more mist outlets. In embodiments, the one or more mist outlets are configured to channel and shape the mist as the mist exits the flame apparatus through the one or more mist outlets. In embodiments, the mist is shaped into a plume as the mist passes through the one or more mist outlets. In embodiments, the one or more mist outlets are disposed above the liquid in the artificial flame apparatus. In embodiments, the one or more mist outlets comprise openings on the artificial flame apparatus. In embodiments, the one or more mist outlets comprises a shaping nozzle.

In embodiments, the shaping nozzle comprises the shape of a cone. In embodiments, the shaping nozzle comprises the shape of a rectangle. In embodiments, the shaping nozzle comprises the shape of a square. In embodiments, the shaping nozzle comprises the shape of a triangle. In embodiments, the shaping nozzle comprises the shape of a circle. In embodiments, the shaping nozzle comprises the shape of a pentagon. In embodiments, the shaping nozzle comprises the shape of a hexagon. In embodiments, the shaping nozzle comprises the shape of a heptagon. In embodiments, the shaping nozzle comprises the shape of a trapezoid. In embodiments, the shaping nozzle comprises any shape known in the art. In embodiments, the shaping nozzle is any of the shaping nozzles described herein.

In embodiments, the shaping nozzle further comprises a diameter. In embodiments, the diameter comprises a line passing from one side of the shaping nozzle through the center of the shaping nozzle to the other side of the shaping nozzle. In embodiments, any of the shaping nozzles described herein comprises a diameter.

In embodiments, a light source may also be configured in proximity to the mist plume, such as around the base of the mist outlet and may project light onto the exiting mist and/or onto the artificial wick. The light emitted by the light source may be a colored light and may change color and/or intensity to produce a more realistic artificial flame.

The mist of an exemplary artificial flame apparatus is produced by a transducer, such as an ultrasonic transducer having a transducer surface that produces vibrations, such as ultrasonic vibrations that create a mist when in contact with liquid. An exemplary transducer may be a piezoelectric transducer. The liquid from a liquid reservoir within the housing may be in contact with the transducer surface directly, via a porous wick or via droplets that impinge on the transducer surface. A portion of the transducer, such as the transducer surface may be in direct contact with the liquid within the liquid reservoir, whereby the transducer surface may be submerged in the liquid. In embodiments, the transducer is in contact with the liquid. A wick, such as a porous wick, may transport liquid from the liquid reservoir to the transducer surface through capillary forces. A pump or gravity feed apparatus may present liquid from the liquid reservoir to the transducer surface and may produce droplets that fall onto the transducer surface, which may more effectively control the variation in the production of mist. In embodiments, the transducer is attached to the wick.

The rate of mist exiting the housing may be varied to change the size, shape or height of the mist plume to produce a more realistic looking artificial flame. In embodiments, the size, shape, or height of the must plume is shaped through use of an air moving device. In embodiments, the air moving mechanism is external to the housing. In embodiments, the air moving mechanism is within the housing. In embodiments, the air moving mechanism shapes the mist as the mist exits the housing. In embodiments, the air moving mechanism produces air flow at the apex of the vapor plume. In embodiments, the air produced at the apex is angled such that the vapor plume is shaped like a real flame. In embodiments, the air moving device comprises a fan.

In embodiments, an oscillator device is utilized to change the rate of flow of the mist from the housing. An exemplary oscillator comprises an air moving device, such as a fan, that forces the mist from the housing or mist reservoir. In embodiments, the air moving device comprises any of the air moving devices described herein. The air moving device may change the airflow rate, or a valve may be configured to modulate the rate of airflow and thereby change the flow rate of mist exiting the housing. An air moving device may produce a flow of air that travels through an airflow conduit and then through inlet ports into the mist reservoir. An exemplary oscillator device is a sonic device that produces sound waves and associated sound or acoustic pressure that pushes the mist from the housing. A sonic device or a sound-wave generator may generate sound waves with a sound wave frequency or varying sound wave frequencies.

In embodiments, the sound-wave generator is configured with a standing wave tube. In embodiments, the standing wave tube comprises one or more mist outlets. In embodiments, the one or more mist outlets are configured to channel and shape the mist as the mist exits through the one or more mist outlets. In embodiments, the standing wave tube comprises one or more mist outlets, whereby the rate of mist exiting the one or more mist outlets may be expelled through the mist outlets as a function of the standing wave frequency and/or magnitude. An exemplary enclosure, such as a tube, standing wave tube, or Ruben's tube, may be configured proximal to the artificial wick and may have a plurality of enclosure openings to produce a plurality of individual mist plumes. In an exemplary embodiment, a standing wave tube is configured around a portion of the artificial wick and may comprise a toroid shaped enclosure that extends around the artificial wick proximal to the one or more mist outlets. The toroid shaped enclosure may have a plurality of enclosure openings around the outer perimeter of the artificial wick. The sound-wave generator of a standing wave tube may produce sound waves having a beat or rhythm or may produce random sound waves. A standing wave tube may be utilized in an artificial flame apparatus having a plurality of individual artificial wicks and flames, such as an artificial fire table or pit, log or fireplace configuration, and the standing wave may have a rhythm or beat, whereby the rate of flow of mist from the one or more mist outlets changes as a function of the standing wave, sound waves, and/or resultant associated sound or acoustic pressure.

A controller may control and vary the functions of the artificial flame apparatus including the power, frequency, waveform and/or rate of mist exiting the housing through one or more housing openings, and may control the transducer, the rate of liquid delivery to the transducer, the color or intensity of the light, the oscillator and the like. A controller may comprise a microprocessor and/or a control circuit. In an exemplary embodiment, a modulator produces a modulation signal that is used to change one or more of the features of the artificial flame apparatus, such as the intensity, color, rate of change of intensity and/or color of the light, and/or the rate of flow of mist from the housing. A modulator may control the transducer to produce mist and to control a variation of the rate of mist produced. A microprocessor may be configured to run a control program that includes a modulation program, thereby making the microprocessor a modulator.

Liquid within the liquid reservoir may comprise water and other agents such as aromatic agents to produce a mist having a scent. An aroma agent, such as a liquid or solid may be mixed directly with the liquid, such as water, in the liquid reservoir or may be placed in a pod whereby the aroma agent is slowly added to the liquid.

An exemplary artificial flame apparatus may be a single flame having a single artificial wick or may comprise a plurality of artificial wicks and flames. An artificial flame apparatus may be in the shape of a log or be configured in a fire table, fire pit or be an insert to a fire feature or fireplace.

An exemplary artificial flame apparatus comprises aromatic oils in the liquid within the housing. In embodiments the aromatic oils comprise essential oils. In embodiments the essential oils are extracted from the housing through a mist.

In embodiments, a device to produce an artificial flame is provided, comprising a liquid, a transducer submerged in the liquid, a shaping nozzle disposed above the liquid and configured to channel mist produced by the transducer, and a light source disposed within the shaping nozzle.

In embodiments, an artificial flame apparatus is provided, comprising a housing, a liquid reservoir within the housing that contains a liquid, a transducer disposed within the liquid, a controller comprising a drive signal in operable communication with the transducer, a shaping nozzle disposed above the liquid and configured to channel mist produced by the transducer within the liquid, and a light source in contact with the shaping nozzle.

In embodiments a method of producing an artificial flame is provided, comprising the steps of contacting a liquid with a transducer to produce a mist, passing the mist through a shaping nozzle, and illuminating the mist with a LED light source.

In embodiments, an artificial flame apparatus is provided, comprising a housing, a liquid reservoir within the housing that contains a liquid, aromatic oils within the liquid, a transducer disposed within the liquid, a controller comprising a drive signal in operable communication with the transducer, a shaping nozzle disposed above the liquid and configured to channel mist produced by the transducer within the liquid, and a light source in contact with the shaping nozzle.

In embodiments, a device to produce an artificial flame is provided, comprising a liquid, a transducer in contact with the liquid, one or more mist outlets disposed above the liquid and configured to channel mist produced by the transducer, and a light source disposed to the light the mist as the mist exits the one or more mist outlets.

In embodiments, an artificial flame apparatus is provided, comprising a housing, a liquid reservoir within the housing that contains a liquid, a transducer having a transducer surface within the housing, wherein said liquid from the liquid reservoir contacts the transducer surface to produce a mist, a controller comprising a drive signal in operable communication with the transducer, one or more mist outlets disposed above the liquid and configured to channel mist produced by the transducer, and a light source to illuminate said mist as the mist exits the housing, wherein the illuminated mist appears as an artificial flame.

In embodiments, a method of producing an artificial flame is provided comprising the steps of contacting a liquid with a transducer to produce a mist, passing the mist through a mist outlet, and illuminating the mist with a LED light source.

In embodiments, an artificial flame apparatus is provided, comprising a housing, a liquid reservoir within the housing that contains a liquid, aromatic oils within the liquid, a transducer in contact with the liquid, a controller comprising a drive signal in operable communication with the transducer, one or more mist outlets disposed above the liquid and configured to channel mist produced by the transducer, and a light source to illuminate said mist as the mist exits the housing, wherein the illuminated mist appears as an artificial flame.

The summary is provided as a general introduction to some of the disclosed embodiments, and is not intended to be limiting. Additional example embodiments including variations and alternative configurations of the disclosed embodiments are provided herein.

BRIEF DESCRIPTION OF SEVERAL VIEWS OF THE DRAWINGS

The accompanying drawings are included to provide a further understanding of embodiments described herein and are incorporated in and constitute a part of this specification, illustrate embodiments, and together with the description serve to explain the principles of the embodiments described herein.

Figure 1:
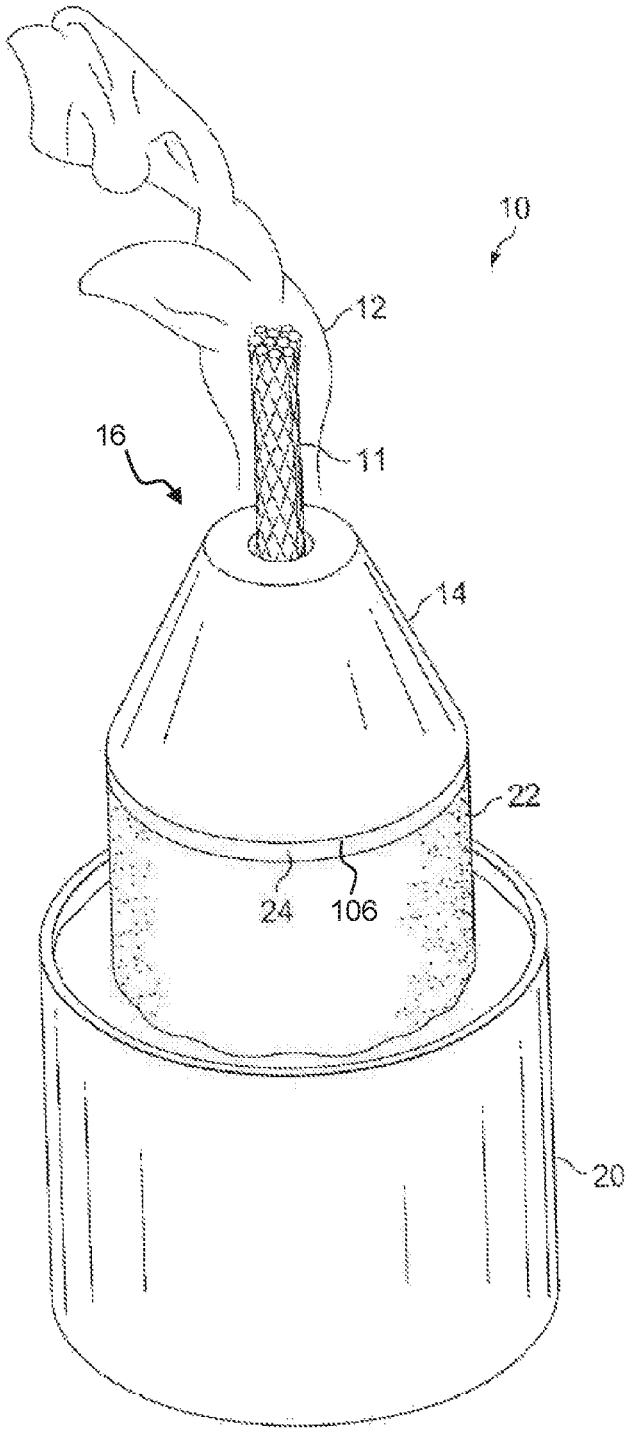
FIG. 1 illustrates a perspective view of an embodiment of this disclosure.

Corresponding reference characters indicate corresponding parts throughout the several views of the Figures. The Figures represent an illustration of some of the embodiments described herein and are not to be construed as limiting the scope of the embodiments described herein in any manner. Further, the Figures are not necessarily to scale, some features may be exaggerated to show details of particular components. Therefore, specific structural and functional details disclosed herein are not to be interpreted as limiting, but merely as a representative basis for teaching one skilled in the art to variously employ the present embodiments.

DETAILED DESCRIPTION OF THE ILLUSTRATED EMBODIMENTS

As used herein the terms "comprises," "comprising," "includes", "including," "has," or "having" or any other variation thereof, are intended to cover a non-exclusive inclusion. For example, a process, method, article, or apparatus that comprises a list of elements is not necessarily limited to only those elements but may include other elements not expressly listed or in inherent to such process, method, article, or apparatus. Also, use of "a" or "an" are employed to describe elements and components described herein. This is done merely for convenience and to give a general sense of the scope of the embodiments described herein. This description should be read to include one or at least one and the singular also includes the plural unless it is obvious that it is meant otherwise.

Certain exemplary embodiments are described herein and are illustrated in the accompanying Figures. The embodiments described are only for purposes of illustration and should not be interpreted as limiting the scope of any of the embodiments described herein. Other embodiments, and certain modifications, combinations and improvements of the described embodiments, will occur to those skilled in the art and all such alternate embodiments, combinations, modifications, improvements are within the scope of the embodiments described herein.

The following description of exemplary embodiments provides information that enables a person skilled in the art to make and use the subject matter set forth in the appended claims, but may omit certain details already well-known in the art. The following detailed description is, therefore, to be taken as illustrative and not limiting.

The example embodiments may also be described herein with reference to spatial relationships between various elements or to the spatial orientation of various elements depicted in the attached drawings. In general, such relationships or orientation assume a frame of reference. However, as should be recognized by those skilled in the art, this frame of reference is merely a descriptive expedient rather than a strict prescription.

Figure 2:
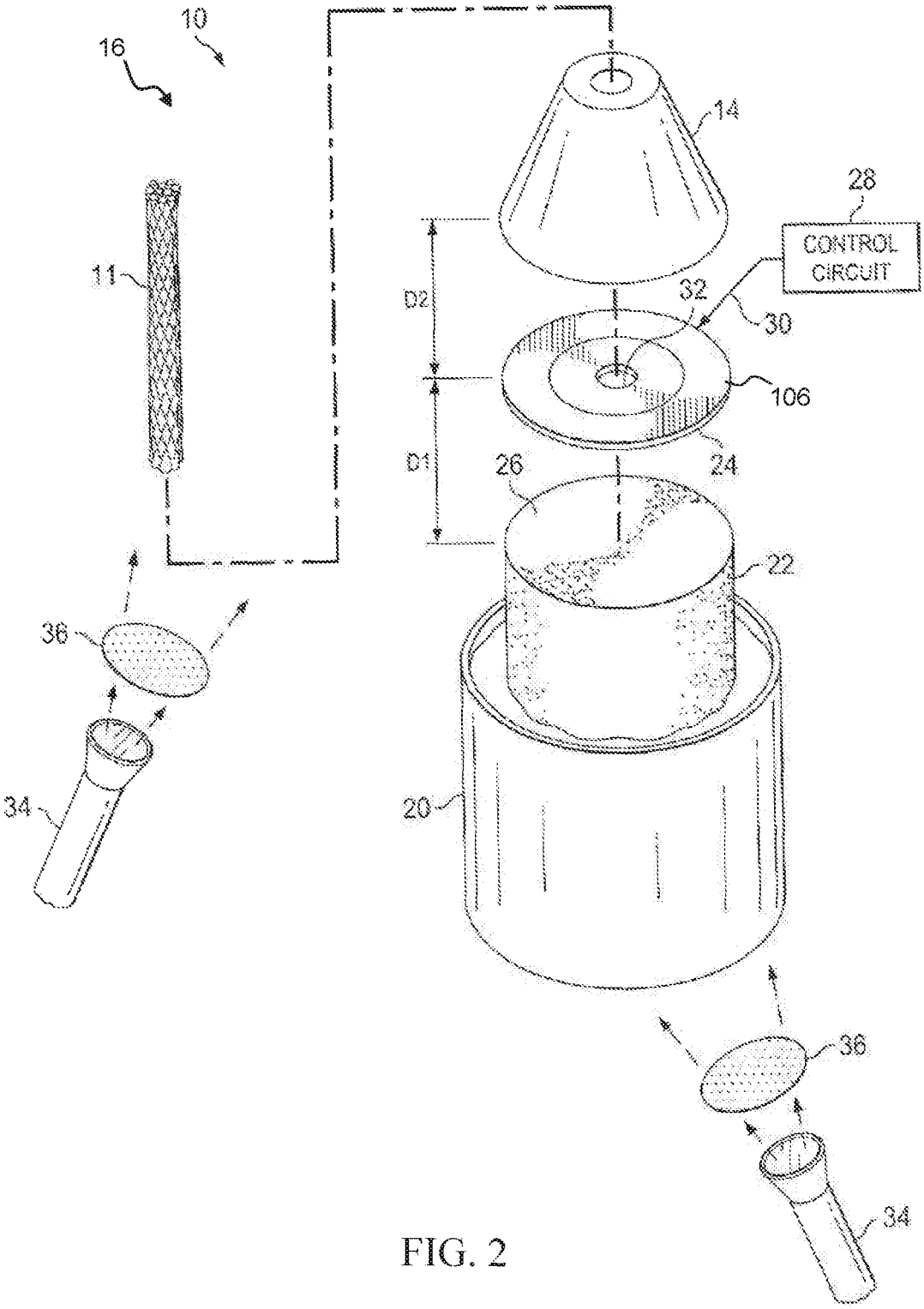
FIG. 2 illustrates an exploded perspective view of the embodiment shown in FIG. 1.

In embodiments, a candle is provided made up of inorganic material. In embodiments, the inorganic material is lead zirconate titanate (PZT). Referring to FIGS. 1 and 2, an exemplary artificial flame apparatus 16 comprises a PZT nebulizer forming a candle shown at 10. In embodiments, the candle 10 is configured to generate a simulated candle flame by controllably and irregularly modulating liquid droplets at a varying power and/or frequency to create an aerosol or mist 12 about an artificial wick 11, and then illuminating the vapor mist 12 to produce a flame-like effect. In embodiments, a nozzle 14 is utilized to produce a variety of effects. In embodiments the nozzle is any substance capable of allowing air, mist, or smoke to pass through it. In embodiments, the nozzle is a shaping nozzle in that it is capable of shaping the air, mist, or smoke as they pass through the shaping nozzle. In embodiments, the liquid comprises water, ethanol, aromatic oils, or any combination of the foregoing. In embodiments, the aromatic oils comprise essential oils.

Referring to FIG. 2, there is shown an exploded perspective view of an embodiment of a candle 10. The candle 10 comprises a reservoir 20 configured to hold a liquid, such as water. A porous wick structure 22 is concentrically positioned in the reservoir 20 and is configured to wick the liquid from the reservoir 20 and present the liquid to an oscillator such as a transducer 106, an ultrasonic resonator 24 as shown. In embodiments, the resonator 24 comprises a PZT piezoelectric ceramic ring resonator and steel membrane assembly that is positioned a distance DI above a top surface 26 of the wick structure 22. In embodiments, the resonator is the active resonant component transducing the liquid into aerosol 12 by means of ultrasonic vibration.

In embodiments, the resonator 24 is controlled by a control circuit 28 that provides a selectively controllable electrical modulated drive signal 30 to control variations in the shape and appearance of the generated aerosol 12. In embodiments, the resonator is any device that is capable of oscillating at certain frequencies. In embodiments, the drive signal is any electrical signal capable of controlling and modulating the control circuit of the resonator. The drive signal 30 may be pulsed, and generated at varying power levels, frequencies and wave shapes to variably control the transducing energy and produce a flame that moves. In embodiments, the movement of the flame mimics a dancing flame-like effect. In embodiments, the flame swirls or floats. In embodiments, the flame produces selected shapes such as those shown in FIG. 6.

In embodiments, the mist directing/shaping nozzle 14, shown as a cone, is configured to shape the aerosol vapor 12. In embodiments the directing/shaping nozzle is a funnel or a device that is shaped like a funnel. In embodiments, the directing/shaping nozzle is any device capable of shaping the aerosol vapor as it passes through the nozzle. The nozzle 14 may be positioned directly on the top surface of the wick structure 22 and above the resonator 24. In embodiments, the nozzle 14 is spaced a distance 02 above the resonator 24, and a distance DI+02 above the wick structure 22 In embodiments, this spacing is achieved through the use of spacers.

In embodiments, the resonator 24 has at least one centrally located transducer opening 32 configured to allow the aerosol 12 to rise through the transducer opening 32, and helps shape the aerosol vapor 12 such that is swirls, floats, or produces other selected shapes. In embodiments, at least one light source 34, which may produce a colored light or be a colored light source, is configured to illuminate the aerosol 12 to create the appearance of a flame. In embodiments, the light source is a natural light source. In embodiments, the light source is an artificial light source. In embodiments, the light source is derived from a luminescent source. In embodiments, the light source is derived from an incandescent source.

In embodiments, the light source is a semiconductor light source. In embodiments, the semiconductor light source is a light emitting diode (LED) source. In embodiments, the LED source is integrated to a fiber optic light source. In embodiments, the light source is within any of the candles or apparatuses described herein.

Figure 15:
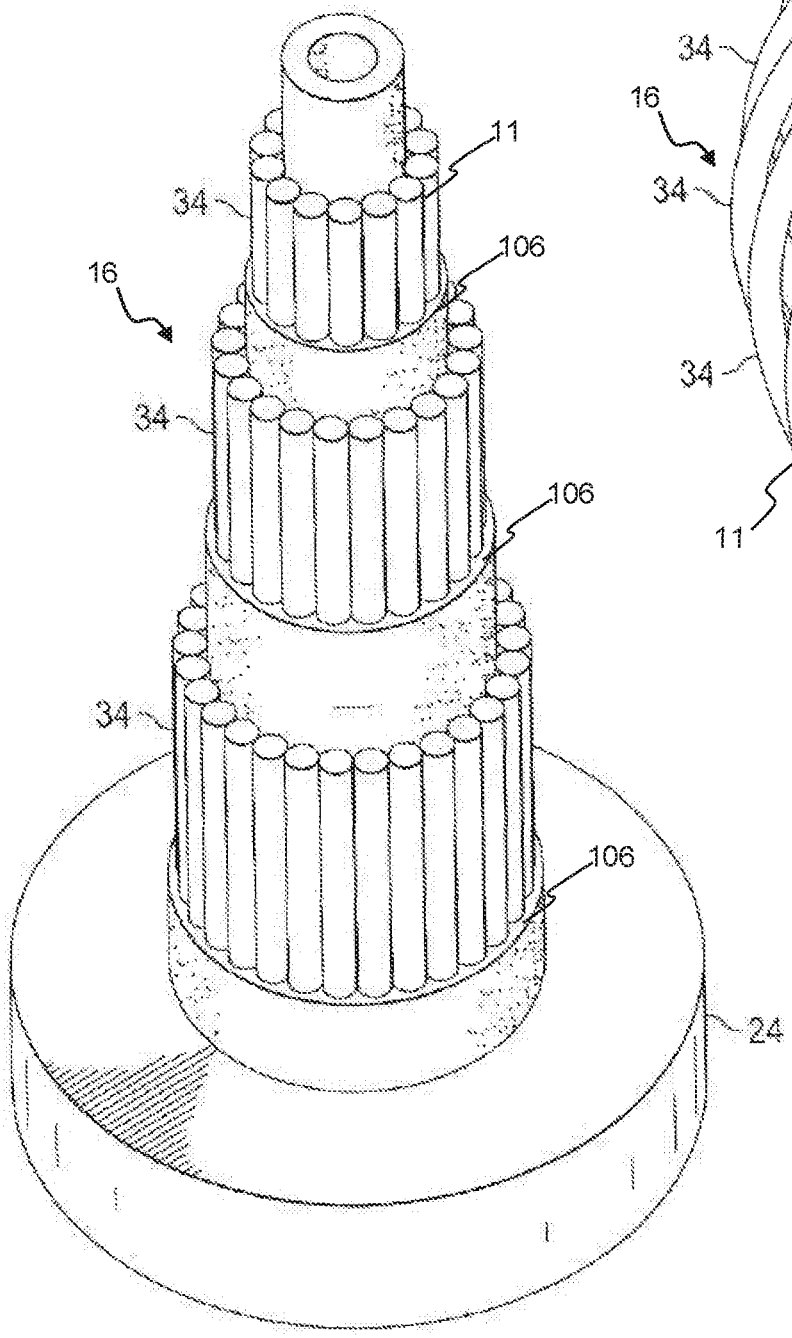
FIGS. 15 and 16 show embodiments helical and tiered artificial wicks, and include intertwined or braided light sources, or fiber optic cables of varying colors, or LED lights/tubes.
Figure 16:
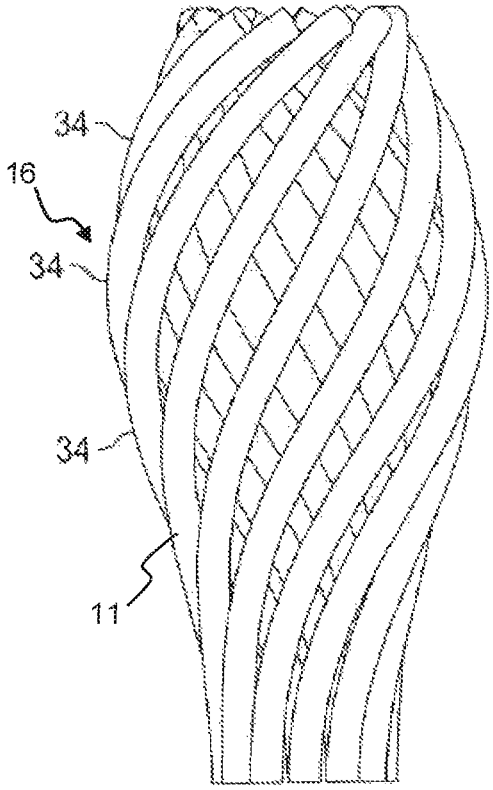

In embodiments, the light source 34 is a light emitting diode (LED) source, integrated fiber optic light source, and is internal to the candle 10 such as shown in FIG. 15 and FIG. 16. Color filters 36 may be used as well. The light source 34 may also comprise a polymer optical filter that provides light to image the aerosol 12. The colors may vary from the blues, yellows, oranges, and red, thereby emulating the varying colors of a flame, and may be intermittent, flicker, travel, or change colors. In embodiments, the color of the light source comprises any one more colors on the visible spectrum (430-770 THz).

In embodiments, the light source is configured to illuminate the mist. In embodiments, the light source illuminates the mist from below. In embodiments, the light source illuminates the mist from above. In embodiments, the light source illuminates the mist from the side. In embodiments, the light source 34 may be configured to illuminate the mist from below, or the candle artificial wick 11 may provide the light source from within the mist, i.e. the candle artificial wick would be encapsulated within the mist. The candle artificial wick 11 may have different shapes. Examples of shapes of the artificial wick included, but are not limited to, helical shaped or tiered shaped. In embodiments, the artificial wick is intertwined or braided with fiber optic cables of varying colors that may travel along the cables, or LED lights/tubes. In embodiments, the varying colors comprise any one or more colors on the visible spectrum (430-770 THz).

Figure 3:
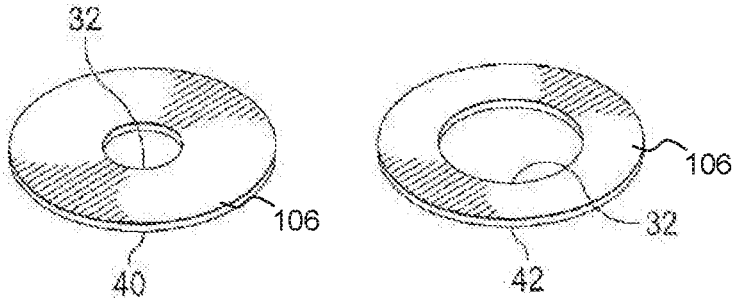
FIG. 3 illustrates alternative resonator designs having different transducer opening sizes.
Figure 4:
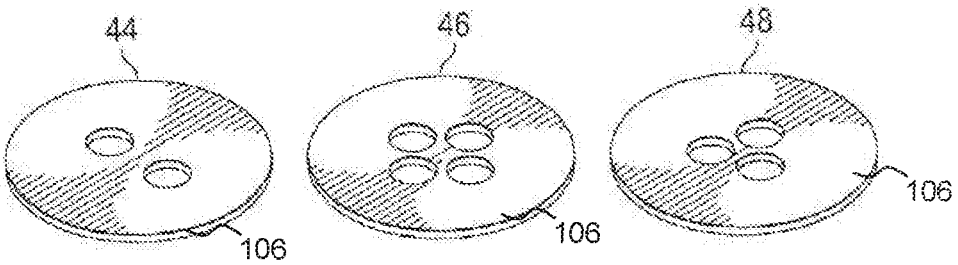
FIG. 4 illustrates alternative resonator designs having multiple transducer openings.

Referring to FIGS. 3 and 4, exemplary transducers 106 may comprise a certain shape, dimension, material type, impressions, perforations, notches, etc. resulting in shaping the liquid into mist/aerosol with flame-like characteristics.

The transducer may be comprised of a metal plate, or a ceramic element/material of suitable composition, electrode patterns, such as solid, wrap-around, side-tab, insulation band, bull's-eye, tolerances such as, capacitance, d33 value, frequency, voltage, shape, size, surface finish, shaping process and/or post-processing, specific patterns or alternative electrode materials including, but not limited to, nickel or gold. The resonator 24 may have larger and/or shaped transducer openings 32, such as shown as resonator 40 and resonator 42 in FIG. 3, or have a plurality of transducer openings 32 as shown with resonators 44, 46 and 48 in FIG. 4. In embodiments, the different transducer opening(s) designs provide varying dielectric resonator responses and resultant aero vapor shapes to produce a different actual flame-like appearance. In embodiments, the resonator is any device that is capable of oscillation.

Figure 5:
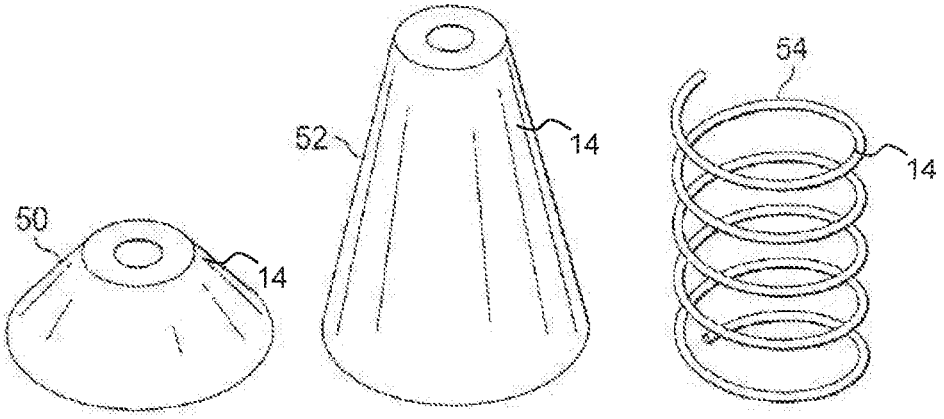
FIG. 5 illustrates alternative nozzle designs.

Referring to FIG. 5, the nozzle 14, or manifold, may have other shapes/sizes, such as shorter cone nozzle 50, or taller cone nozzle 52, or be configured as a spiral nozzle 54. In embodiments, the nozzle can be any shape that is capable of shaping a substance as it passes through the nozzle. In embodiments, the various nozzles 14 help shape the aerosol, and also control the height and variations in the height of the aerosol 12. In embodiments, substances other than aerosol pass through and are shaped by the nozzle. These substances include, but are not limited to, mist and water. The nozzle 14 can be created via fast 3-D printing techniques, enabling a variety of aerosol 12 shapes. In embodiments, a cone shaped nozzle is used to shape the exiting mist to resemble a flame.

Figure 6:
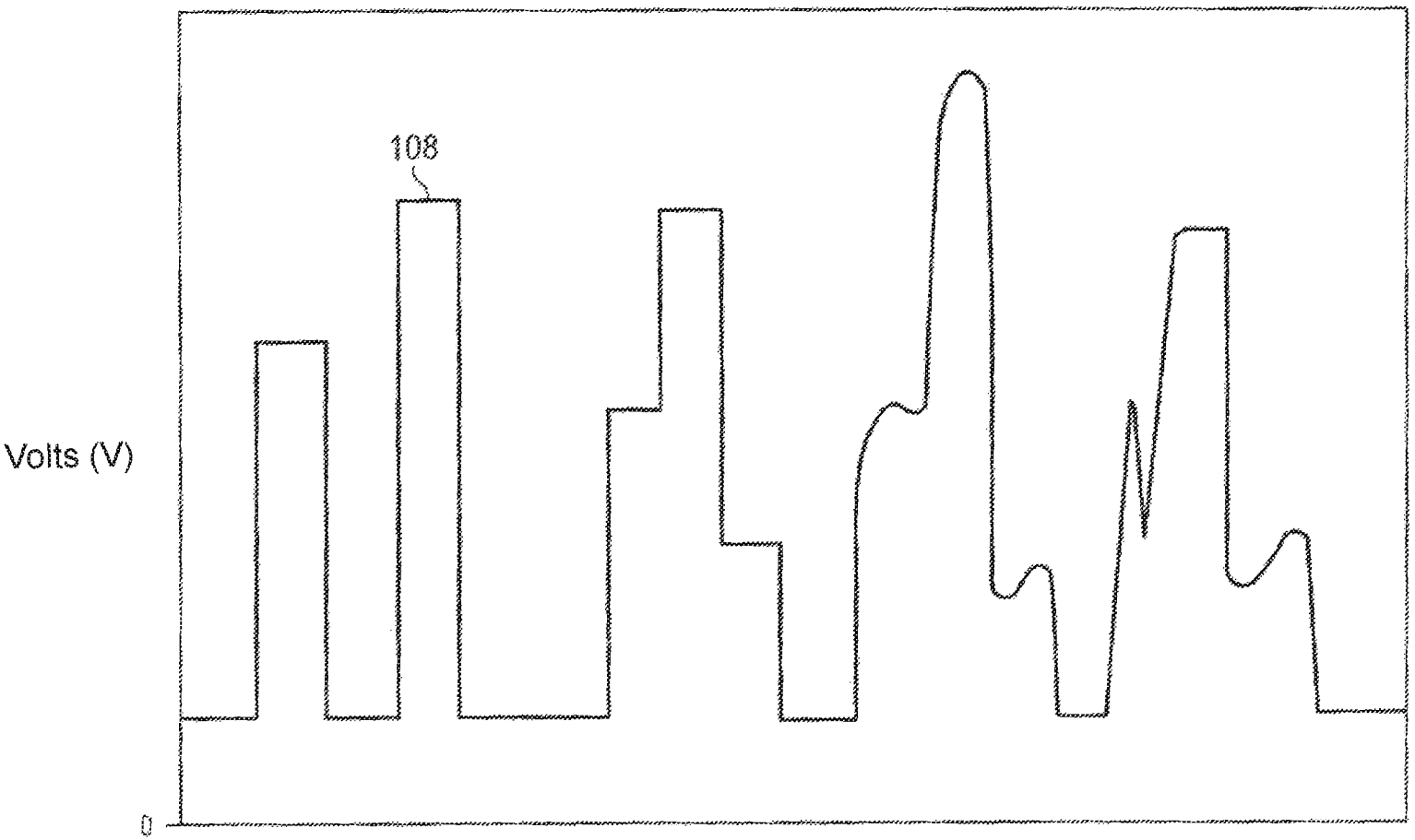
FIG. 6 illustrates a representative waveform diagram(s) depicting a drive signal from the control circuit to modulate the resonator.

FIG. 6 shows an example drive signal 108 delivered to the transducer 106 to create and control variations in the mist plume 12. The drive signal 108 may be a digital signal or an analog signal. Variations in amplitude and frequency of the signal may create variations in the mist plume 12.

Figure 7C:
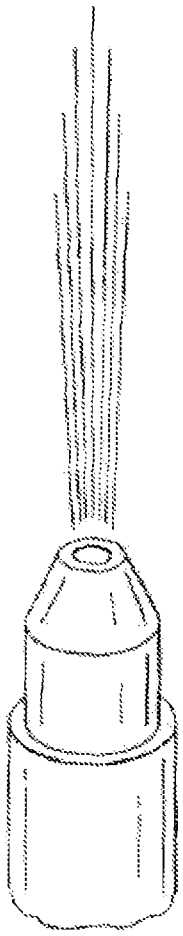
FIGS. 7A-7C illustrate different simulated flames that are generated by various embodiments of the disclosure.
Figure 7B:
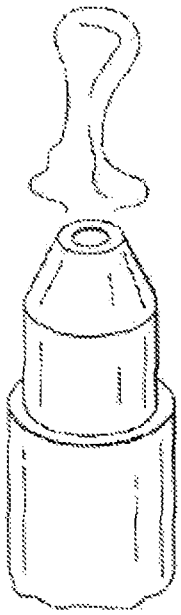
Figure 7A:
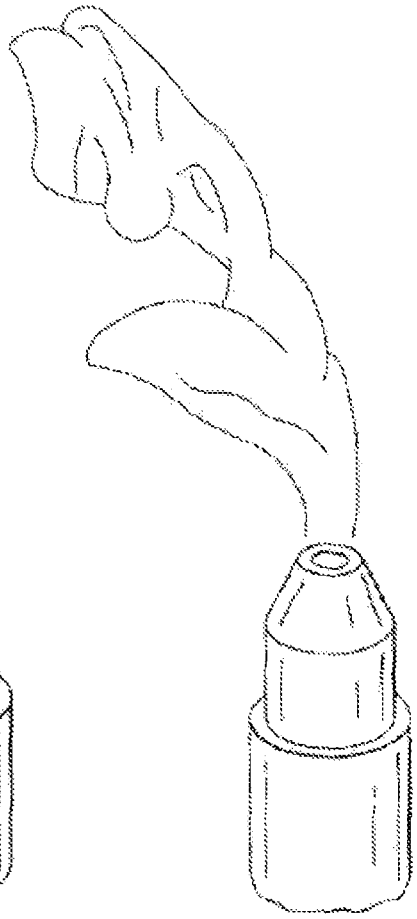

Various illuminated aerosol vapors that can be created are shown in FIG. 7A, FIG. 7B and FIG. 7C.

Alternative embodiments of this disclosure are shown in FIGS. 8-17. These embodiments create a realistic multiuse, multiplatform flame technology. These embodiments include fireplace units that are fully integrated and can be incorporated into any sized opening or manufacturer's firebox, along with any available log set on the market. This creates a realist looking, safe alternative to fire.

Figure 8:
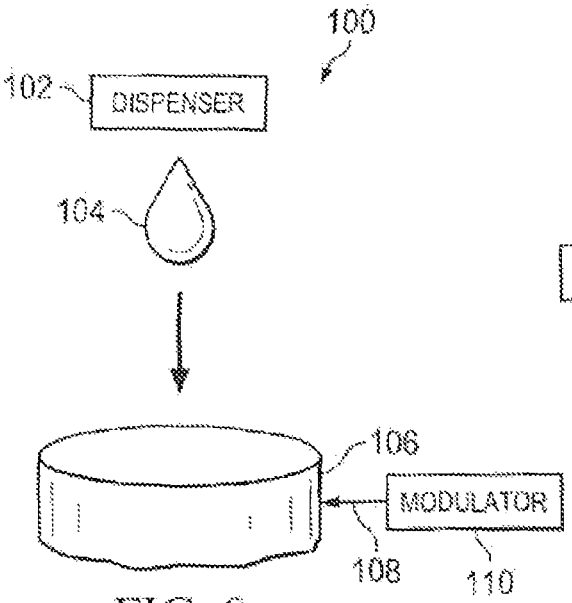
FIGS. 8-11 illustrate an apparatus and method of dispensing droplets of a fluid on a transducer to create a mist plume.

One illustrative embodiment shown in FIGS. 8-11 comprises an imitation flame generator 100 that includes realistic vapor flame technology (RVFT) utilizing variable evaporating droplet technology (VEDT). This generator 100 comprises a liquid dispenser 102 configured to dispense liquid droplets 104 onto a piezoelectric transducer 106, as shown in FIG. 8. The dispenser 102 can take many forms, and may include a fluid reservoir, or may receive fluid via a conduit feeding one or more openings. In embodiments, the transducer 106 is driven by a modulated resonating drive signal 108 generated by a modulator 110. The modulator 110 may be comprised of a Class E inverter and/or a piezoelectric transformer. The dispenser 102 may be comprised of devices and/or effects such as capillary effect, use of solenoid valves, a cavitation process tubes, pumps, wicking effect, and/or the implementation of fluidic technology such as switches, amplifiers, oscillators, and the like, that control the specific droplet size being dispensed onto the transducer.

Figure 9:
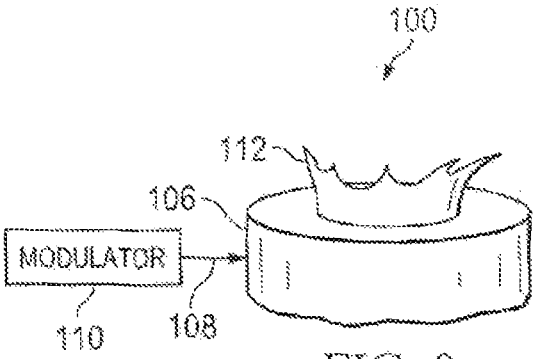

As shown in FIG. 9, the droplet 104 impinges upon transducer 106 to disperse, like a splash as shown at 112. The droplets 104 may be of different sizes and be intermittently disposed/placed on certain/key places on the transducer 106 by the dispenser. The mist changes shape and size as a function of the varying size/shape of the droplets being dispensed to the transducer.

Figure 10:
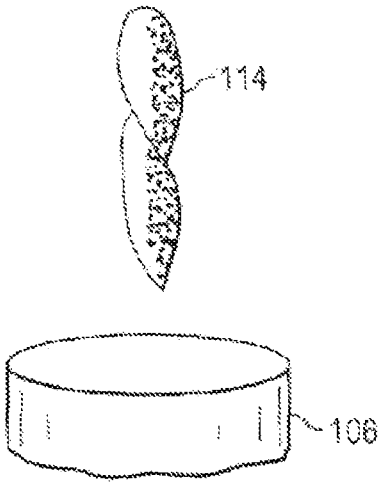
Figure 11:
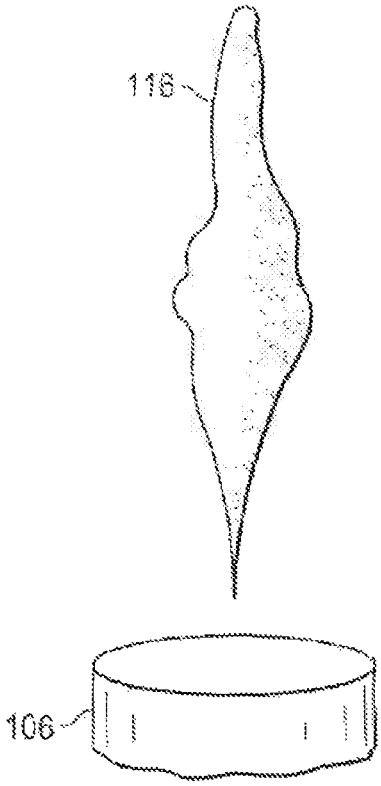

As shown in FIG. 10, the modulated transducer 106 causes the dispersed droplet 112 to transduce and form a mist/aerosol 114 that rises from the transducer 106. The varying energy of drive signal 108 delivered to the transducer 106 causes the mist 114 to transform into a vapor plume 116, as shown in FIG. 11. In embodiments, varying energy of the drive signal 108, as shown in FIGS. 8 and 9, to the transducer 106 results in the liquid being atomized/nebulized at different mist/aerosol droplet sizes. The drive signal which may be generated by the modulator may produce a drive signal with irregular varying frequencies, irregular power, pulse width modulation ratios and the like. This variation in mist/aerosol droplet sizes results in varying heights, shapes/sizes of the plume 116. This modulation of energy to the transducer 106, varying liquid droplet sizes onto the transducer 106, and/or the resultant varying mist/aerosol droplet sizes cause the vapor plume 116 to move up and down, emulating the dancing effect of a real flame. This is the resultant of the vapor-resonator interface.

In one illustrative embodiment, the resonant frequency of the drive signal 108 of the modulated transducer 106 is a driving signal of 28.52 kHz, at an operating power about 20 Watts. In embodiments, the frequency of the drive signal is less than 28.52 kHz. In embodiments, the frequency of the drive signal is greater than 28.52 kHz. In embodiments, the frequency is about 100 kHz. In embodiments, the diameter of the transducer 106 is 26 mm (about 1 inch). In embodiments, the diameter of the transducer 106 is less than 26 mm. In embodiments, the diameter of the transducer 106 is greater than 26 mm. In embodiments, the flame effect is the generated irregular, ultrasonic wave that spreads upwards from the modulated transducer. In embodiments, aromatic oils such as essential oils can be added to the liquid and diffused for scented candles.

The transducer 106 arrangements can be one of a number of types. In embodiments, the transducer is an ultrasonic transducer. In embodiments, the transducer is a pressure transducer. In embodiments, the transducer is a temperature transducer. In embodiments, the transducer is a piezoelectric transducer. In embodiments, any of the flame generators described herein comprises any one or more of an ultrasonic transducer, a pressure transducer, a temperature transducer, and a piezoelectric transducer.

In embodiments, a piezoelectric transducer creates a high frequency mechanical oscillation just below the surface of a source of water, such that an ultrasonic vibration turns the liquid into mist. The dispensed fluid, such as water, may be dispersed as onto the modulated transducer 106 to take advantage of gravity. The droplets may be a substantially consistent size or inconsistent size. The water may be injected onto the transducer 106 using an injector, and the water may be a standing liquid residing in a basin. The fluid can be transported, dropped, placed, pushed onto, through transducer 106 in many fashions. The implementation of capillary effect, use of solenoids, tubes, pumps, wicking effect, and/or the implementation of fluidic technology such as switches, amplifiers, oscillators, and the like, may be utilized to effectively transport liquid and/or create plume motion and support functions that may allow for the movement of specific sized droplets of liquid onto the transducer. The liquid may be added onto the transducer through any physical, mechanical, or electrical means. In embodiments, the liquid is injected, pumped, or pressurized onto the transducer 106. Liquid droplets may be created on the transducer through any physical, mechanical, or electrical means. In embodiments, a fluidic switch and/or a solenoid valve may be utilized to effectively create and move specific sized droplets of liquid for movement and release onto the transducer 106. Random plume sizes as droplets may be created to result in flame heights that mimic a real flame. In embodiments, a system of fluid supply channels through a solenoid valve, and/or a cavitation process, may provide random plume sizes as droplets are intermittently delivered onto the transducer to create various flame heights to mimic a real flame. Integrated circuitry may allow random frequency/power modulation of the transducer. Variable droplet size may be achieved through a fluidic valve delivery system or through a modulated pump system disseminating fluid onto the transducer in several fashions including, but not limited to, dropping via gravity, pushing or pumping, capillary effect, injecting and the like. The liquid may be brought into contact from below, the side, and/or the center onto the transducer.

Figure 12:
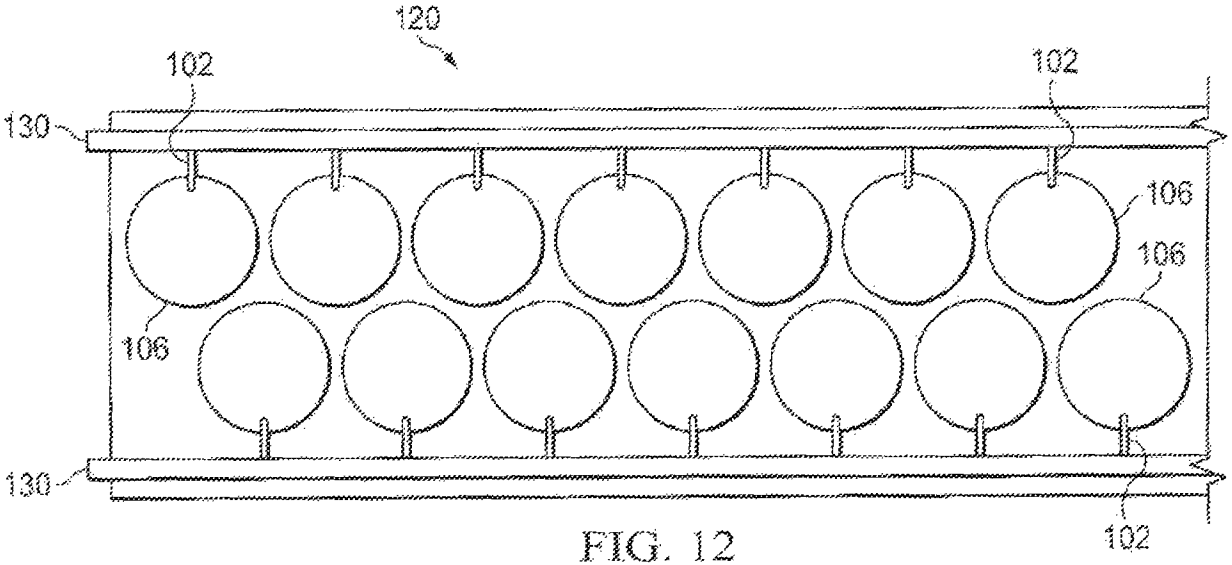
FIG. 12 illustrates an insert comprised of multiple embodiments.
Figure 13:
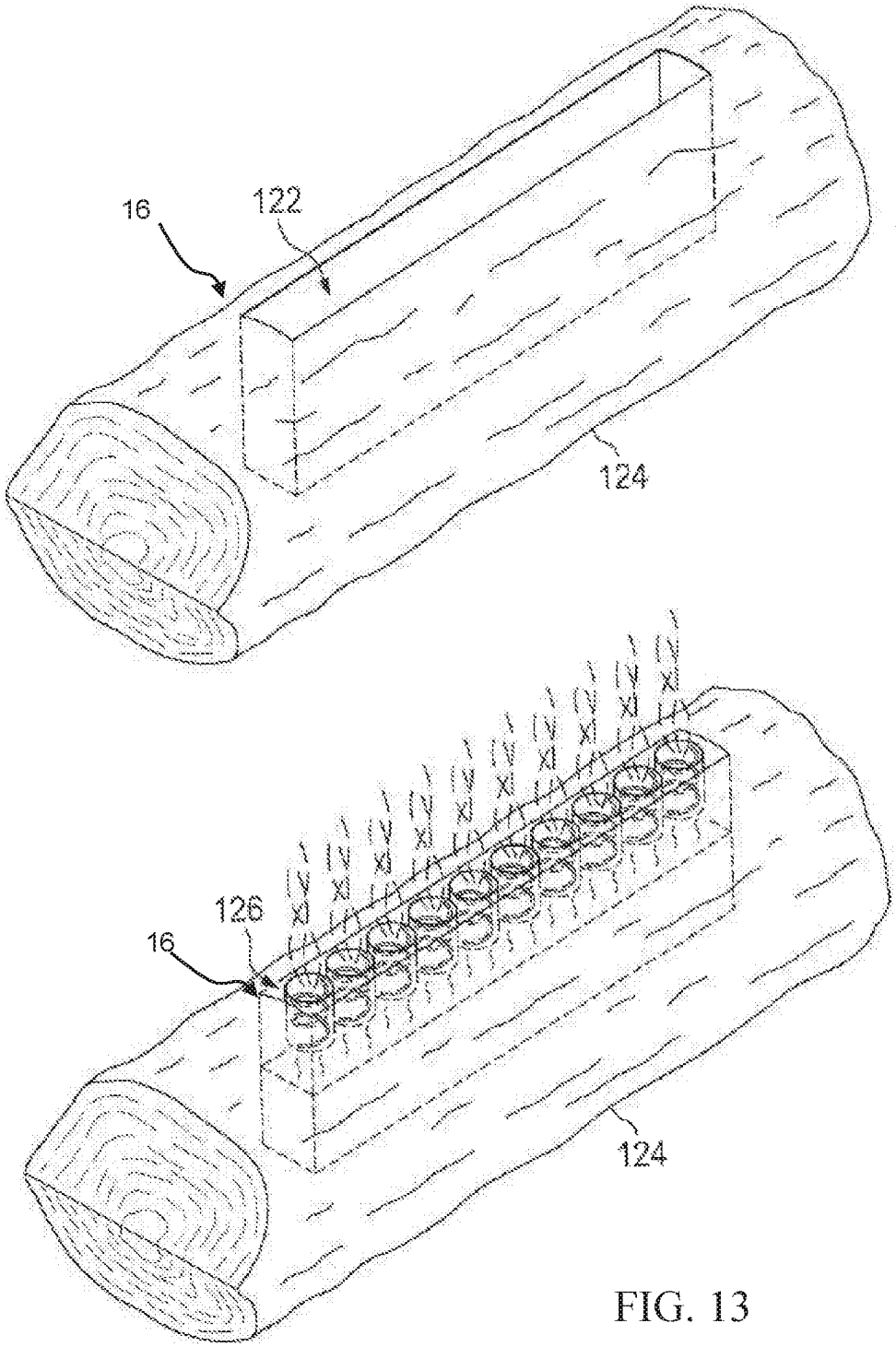
FIG. 13 illustrates an imitation log for receiving the insert.

One embodiment comprises a fireplace insert 120 as shown in FIG. 12, where several transducers 106 may be lined up in a varying tiered offset radius pattern, with random droplet sizes being dispensed onto the transducers 106 at different intervals, creating a realistic dancing vapor flame. The insert 120 may be positioned in a recess 122 of a carved log 124 such as shown in FIG. 13. An artificial fire log or artificial flame configured with a log or log shaped housing may comprise a Ruben's tube having a transducer that creates sound waves that vary the shape, size and/or height of the flame from the individual enclosure openings, as shown in FIGS. 1 and 3 of provisional patent application No. 62/554,419; incorporated by reference herein.

Figure 14:
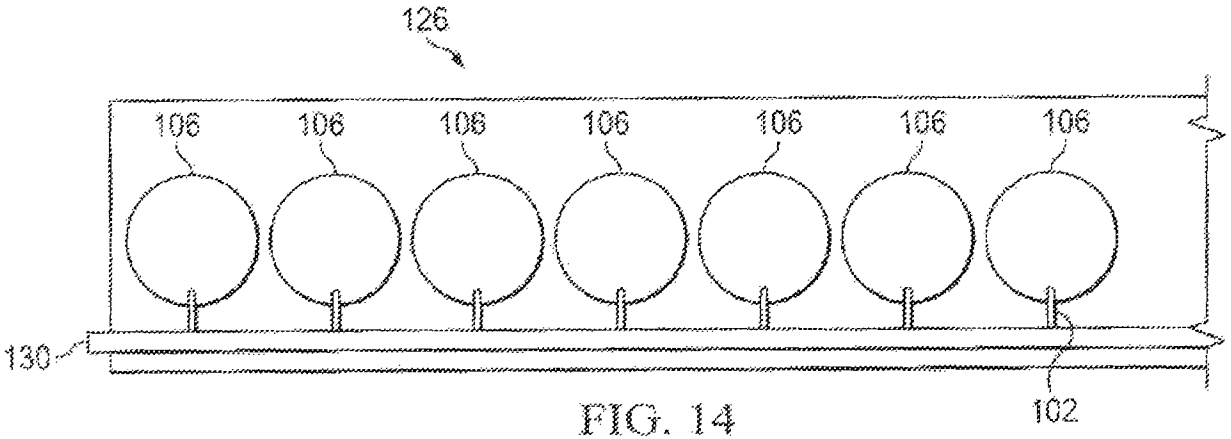
FIG. 14 illustrates another embodiment of an insert.

FIG. 14 shows an insert 126 having linearly arranged transducers 106. The dispensers 102 comprise nozzles fed by a conduit 130, which conduit 130 is fed by a liquid such as water from the fluid reservoir.

FIGS. 15 and 16 show embodiments of helical and tiered artificial wicks, and include intertwined or braided light sources, or fiber optic cables of varying colors, or LED lights/tubes. Light sources 34 may be arranged in a tiered configuration with a transducer 106 at each tier. The light sources 34 may be shaped to create an artificial wick 11 that may simulate the shape of a flame or a wick.

Figure 17:
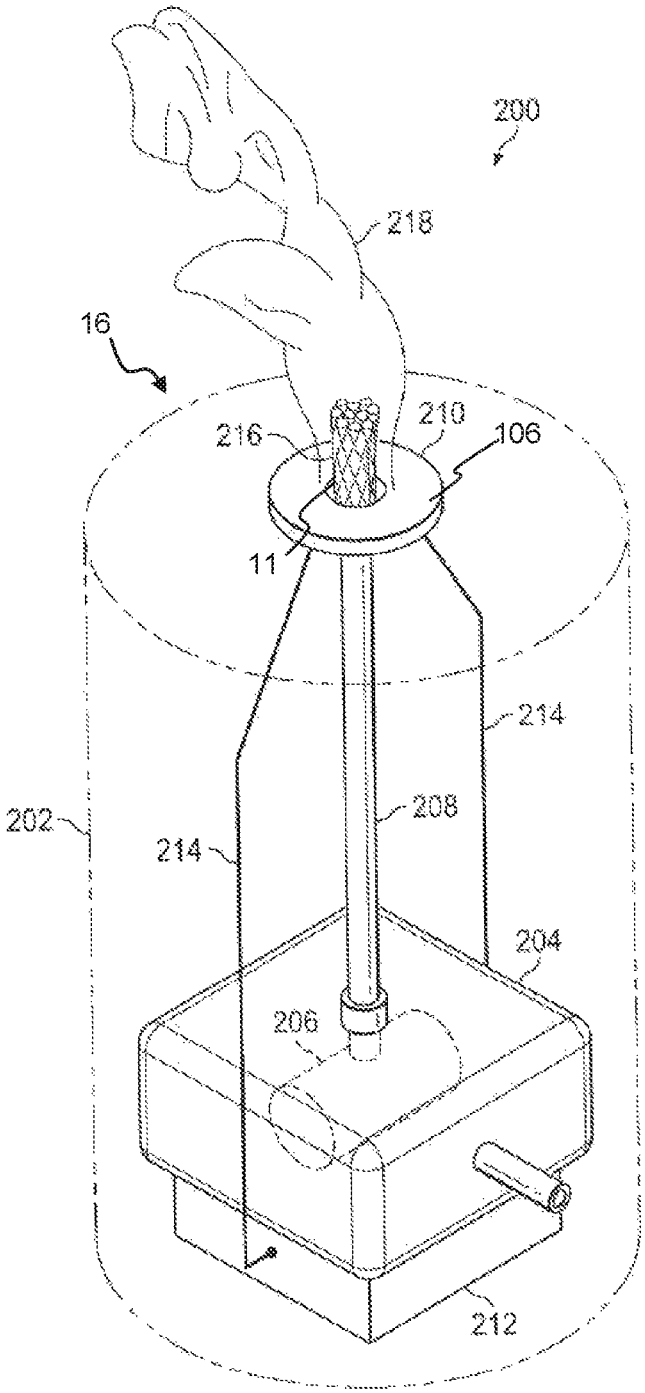
FIG. 17 shows another embodiment including a liquid reservoir and pump.

FIG. 17 shows another embodiment of a candle at 200, shown to include a body 202, liquid reservoir 204, pump motor 206, liquid delivery conduit 208, resonator 210, control circuit 212, electrical conductors 214 providing a modulated drive signal, artificial wick 216, and vapor plume 218. In embodiments, the pump 206 delivers liquid in constant or varying droplet sizes from reservoir 204 via vertically extending conduit 208 to proximate the resonator 210. The resonator 210 modulates the presented liquid to create the vapor plume 218, wherein varying the power and/or waveform of the modulated control signal generated by control circuit 212 causes the vapor plume 218 to shape. The pump motor 206 may deliver liquid in varying droplet sizes causing the vapor plume 118 to shape. One or more light sources, such as LED fibers, can be disposed in or about the artificial wick 216 to color the vapor plume 218 and resemble a flame.

Figure 18:
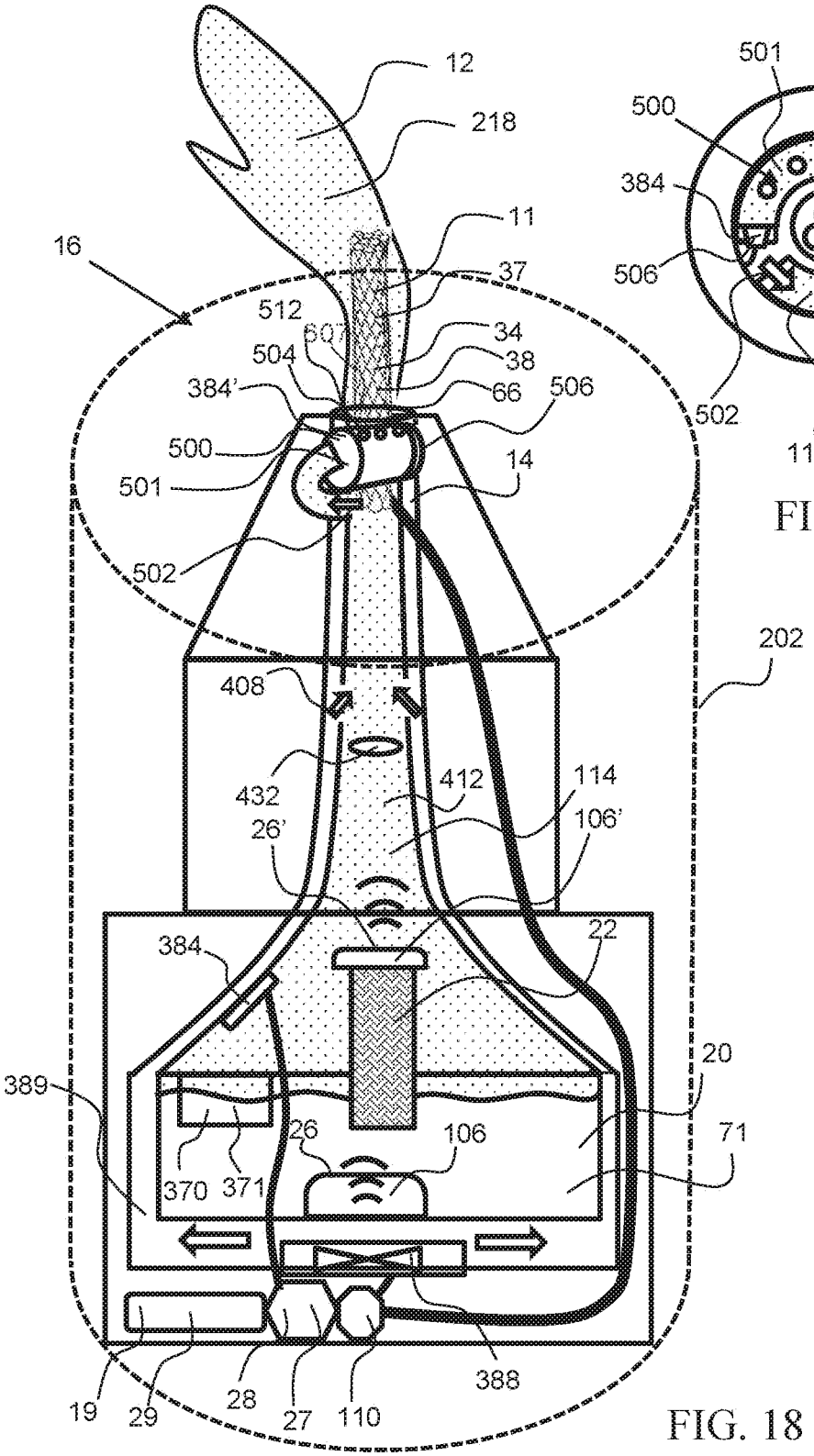
FIG. 18 shows an exemplary artificial flame apparatus comprising a liquid reservoir, a transducer to produce a mist, an oscillator to vary the rate of flow of the mist from the housing and a plurality of light sources configured to illuminate said mist exiting the housing.

As shown in FIG. 18, an exemplary artificial flame apparatus 16 comprises a liquid reservoir 20, transducers 106 (106') to produce a mist 114 that collects in the mist reservoir 412. An oscillator 384 varies the rate of flow of the mist from the housing 202 such that the vapor plume 218 of mist changes shape or height. The oscillator 384, which may produce waves, pressure gradients and/or vibrations, may cause the flow of the mist to pulsate, swirl, etc., producing a dancing flame effect to the resultant vapor plume. A light source 34 may be configured to illuminate the vapor plume 218 or vapor mist 12 exiting the housing around the artificial wick 11 and may also illuminate the artificial wick 11. The artificial wick 11 may comprise the light source 34 and may comprise a fiber optic 37 or light tube 38, for example. As described herein, the fiber optic or light tube may be configured to look like a wick or flame and/or a plurality of light sources, such as fiber optics or light tubes may be twisted about each other, such as spiral wrapped, tiered, helical, braided etc. The light emitted by the light source may be a colored light and may change color and/or intensity to produce a more realistic artificial flame. A portion of the fiber optic or light tube may be colored, and a portion may be translucent or transparent to allow the light to emit therefrom. The cover nozzle 14 may be of various shapes to channel and shape the vaporized mist generated from the resonator 106 as it exits the housing 202. In embodiments, the cover nozzle comprises one or more apertures at one of its ends. In embodiments, the cover nozzle comprises two apertures. In embodiments, the cover nozzle comprises three apertures. In embodiments, the cover nozzle comprises four apertures. In embodiments, the cover nozzle comprises more than four apertures.

A light source, such as a ring of light 66, may be configured proximal to the enclosure opening 504 or at the nozzle exit or at the mist outlet 607 and this light source may produce a colored light such as white, blue, red, orange, yellow, etc., to reflect and illuminate the mist and vapor plume 218, and/or an artificial wick 11. The light emitted by the light source may be a colored light and may change color and/or intensity to produce a more realistic artificial flame. One or more light sources, such as fiber optic cables and/or filaments, LED fiber(s), can be disposed in or about the artificial wick 11 to color the vapor plume 218 to resemble a flame. The artificial wick, or a portion thereof, may also be colored to resemble a burnt candle wick. The wick may be helical, tiered, shaped, molded, and may include intertwined or braided light sources such as fiber optic cables of varying colors, or LED lights/tubes.

An air moving device 388, such as a fan, may produce a flow of air, as indicated by the bold arrows that forces the mist 114 from the housing. Power to the fan may be modulated to control a flow of air to further shape and control the mist plume. As shown, the air moving device produces a flow of air that travels through flow conduits 389 and then through inlets 408 into the mist reservoir 412 to force the mist 114 out of the housing 202. A splash guard 432 may be configured to prevent large droplets of liquid from entering and/or exiting the housing through the nozzle 14. The splash guard may prevent condensation droplets from dropping onto the transducer. The air moving device may be controlled by a controller 27 having a control circuit 28 and a modulator 110 that changes air moving device output, which may change the flow rate of the airflow and subsequently the rate of mist exiting the housing. A modulator may also regulate the transducers to vary the rate of mist production, as a function of a controller. A modulator may also control the light emitted by the light source by changing colors and/or intensity to produce a more realistic artificial flame. A shaping nozzle 512 may be configured to shape the mist as it exits the housing to form a flame shaped vapor plume 218.

As shown in FIG. 18, there are two representative transducers 106 and 106'. The first transducer 106', is located outside the liquid reservoir 20 and comes in contact with a liquid 71 from the liquid reservoir via a porous wick structure 22 that draws liquid from the liquid reservoir via capillary forces to the transducer surface 26'. A second representative transducer 106 is located within the liquid reservoir 20. The transducer surface 26 of the transducer 106, or mist producing surface, is in direct contact with the liquid of the liquid reservoir. An exemplary artificial flame apparatus 16 may comprise one transducer or a plurality of transducers. The one transducer or plurality of transducers may comprise any of the transducers described herein.

As shown in FIG. 18, a pod 370 is configured to retain an agent or plurality of agents, such as an aroma agent 371 that mixes with the liquid in the liquid reservoir to produce a mist having a fragrance or scent. In embodiments, the aroma agent comprises one or more aromatic oils. In embodiments, the one or more aromatic oils comprise one or more essential oils.

The vapor mist 12, or vapor plume 218 produced by the exemplary artificial flame apparatus 16 may be configured to oscillate or change shape, size or height to mimic a real flame that moves, dances, and changes shape. An oscillator 384 may create sound waves, vibrations, or pressure gradients that force the mist 114 from the housing 202 at a variable rate, thereby creating a changing plume. In embodiments, the oscillator produces an output signal of varying frequencies. In embodiments, the frequency is at least 10 Hz. In embodiments, the frequency is greater than 10 Hz, for example between 15 Hz and 100 Hz, or between 100 Hz and 100 GHz. An oscillator may produce sound waves, sound pressure or acoustical pressure, and may be configured with a standing wave tube 500, also referred to as a Ruben's tube. An oscillator may be used to create waveforms controlling properties such as amplitude, frequency, rise time, time interval, distortion and others. Mist 114 may enter an inlet 502 to an enclosure 501 of the standing wave tube and a sound wave generator 506 may create sound waves/sound pressure that travel along the enclosure 501 forcing the mist out of enclosure openings 504 in the enclosure 501. The mist may be expelled from the enclosure openings as a function of the sound wave, or sound pressure, whereby it may change at a rhythm or beat of the sound wave. The controller 27 and/or modulator 110 may control the sound generator 506 to produce a mist that moves to a particular beat or rhythm due to the controlled variation in the sound waves. This variation may be the product of an acoustical selection or creation, sound wave pattern creation, modulated sound wave pattern or may be random. The oscillator may be a surface acoustic device.

An exemplary artificial flame apparatus may comprise a power source 29, such as a battery or rechargeable battery 19 or a wired power connection, such as a plug adapted to be plugged into an electrical outlet including a wall outlet or a Universal Serial Bus (USB) outlet/micro USB or similar manner. In embodiments, a rechargeable battery is configured within the housing 202 of the artificial flame apparatus and is configured to be recharged through a USB connection.

Figure 19:
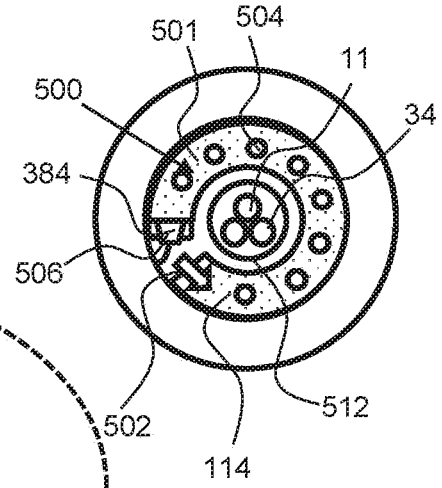
FIG. 19 shows an exemplary oscillator comprising a standing wave tube 500, also referred to as a Ruben's tube that is configured in a circular form around the artificial wick 11.

As shown in FIG. 19, an exemplary oscillator 384 is a standing wave tube 500, also referred to as a Ruben's tube that may be configured in a circular form, wherein the enclosure 501, such as a tube, extends in an arc around the artificial wick 11. The mist may enter the enclosure 501 through an inlet 502 and a sound generator, an oscillator 506, may produce sound waves and sound pressure that forces the mist 114 from the enclosure opening 504. In embodiments, the enclosure extends around a portion of the artificial wick and the artificial wick comprises a light source 34. A shaping nozzle 512 may be configured to shape the mist as it exits the housing to form a flame shaped vapor plume 218.

Figure 20:
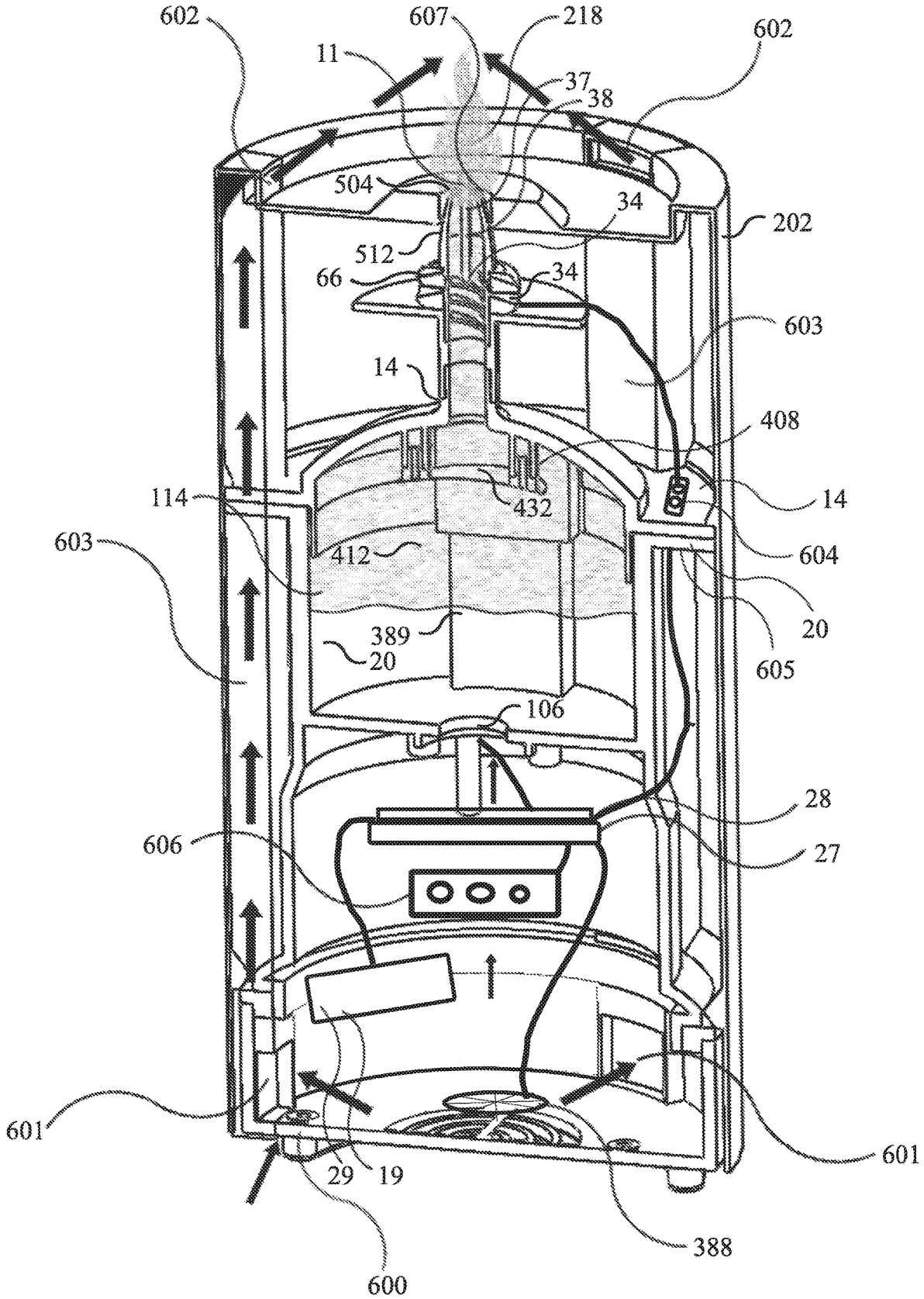
FIG. 20 shows an exemplary embodiment of a candle, configured to generate a simulated candle flame. Among others, it depicts controlling the functionality of internal and external airflow to further control and shape the mist, and to emulate the look, shape, lighting, and dancing effects of a flame.

FIG. 20 is an embodiment of an artificial flame apparatus, configured to generate a simulated flame in which the mist/vapor is shaped into a simulated vapor plume through the use of airflow. The artificial flame apparatus comprises a liquid reservoir 20, transducer 106 to produce a mist 114 that collects in the mist reservoir 412 and moved by airflow up through cover nozzle 14, through an optional shaping nozzle 512 and through the enclosure opening 504 and mist outlet 607. A light source 34 may be configured to illuminate the vapor plume 218 exiting the housing around the artificial wick 11 and may also illuminate the artificial wick 11. The artificial wick 11 may comprise the light source 34 and may comprise a fiber optic 37 or light tube 38, for example. In embodiments, the fiber optic or light tube is configured to look like a wick or flame and/or a plurality of light sources, such as fiber optics or light tubes. In embodiments, the fiber optic or light tube is twisted about each other, such as spiral wrapped, tiered, helical, braided etc.

In embodiments, the light emitted by the light source is a colored light and may change color and/or intensity to produce a more realistic artificial flame. In embodiments, a portion of the fiber optic or light tube is colored. In embodiments, a portion of the fiber optic or light tube is translucent or transparent to allow the light to emit therefrom. In embodiments, the cover nozzle 14 is of various shapes to channel and shape the vaporized mist generated from the transducer 106 as it exits the housing 202. A light source, such as a ring of light 66, may be configured proximal to the enclosure opening 504 or at the nozzle exit or at the mist outlet 607 and this light source may produce a colored light such as white, blue, red, orange, yellow, etc., to reflect and illuminate the mist and vapor plume 218, and/or an artificial wick 11. The light emitted by the light source may be a colored light and may change color and/or intensity to produce a more realistic artificial flame. One or more light sources, such as fiber optic cables and/or filaments, and LED fiber(s), can be disposed in or about the artificial wick 11 to color the vapor plume 218 to resemble a flame. In embodiments, the artificial wick, or a portion thereof, is colored to resemble a burnt candlewick. In embodiments, the wick is helical, tiered, shaped, molded, and may include intertwined or braided light sources such as fiber optic cables of varying colors, or LED lights/tubes.

An alternative embodiment of a candlewick may be comprised of a two-dimensional (2-D) and/or three-dimensional (3-D) light-reflective, translucent, transparent, non-light-reflective and/or other material of various shapes (e.g. 2-D or 3-D flame profile/outline/silhouette) and/or sizes. The candlewick may be cut, stamped, molded/3-D printed, etc. The candle wick may be illuminated from within by one or more colored light sources, such as fiber optic cables and/or filaments, LED fiber(s), etc. The candle wick may be illuminated by reflective light onto the 2-D or 3-D material by one or more colored light sources, such as fiber optic cables and/or filaments, LED fiber(s), etc. The mist plume may surround, engulf, submerge, circumnavigate, encompass, etc. the candlewick described in this paragraph.

In embodiments, an air moving device 388 or plurality of air moving devices may produce a flow of air, as indicated by the bold arrows that forces the mist 114 from the housing. In embodiments, the air moving device or plurality of air moving devices is/are a fan(s). In embodiments, the air moving device produces a flow of air that travels through flow conduit(s) 389 and then through inlet(s) 408 into the mist reservoir 412 to force the mist 114 out of the housing 202. A splashguard 432 may be configured to prevent large droplets of liquid from entering and/or exiting the housing through the nozzle 14. The splashguard may prevent condensation droplets from dropping onto the transducer. The splashguard may help direct the flow of air, and/or the flow of mist out of the mist reservoir. The air moving device may be controlled by a controller 27 having a control circuit 28. The control circuit may control the light emitted by the light source by changing colors and/or intensity to produce a more realistic artificial flame. A shaping nozzle 512 may be configured to further shape the mist as it exits the housing to form a flame shaped vapor plume 218. Transducer 106 is located within the liquid reservoir 20. The surface of the transducer, or mist-producing surface, is in direct contact with the liquid of the liquid reservoir. The vapor plume 218 produced by the exemplary artificial flame apparatus may be configured to oscillate or change shape, size or height to mimic a real flame that moves, dances, and changes shape.

An exemplary artificial flame apparatus may comprise a power source 29, such as a battery or rechargeable battery 19 or a wired power connection, such as a plug adapted to be plugged into an electrical outlet including a wall outlet or a Universal Serial Bus (USB) outlet/micro USB or similar manner. In an exemplary embodiment, a rechargeable battery is configured within the housing 202 of the artificial flame apparatus and is configured to be recharged through a USB connection. The apparatus may comprise a capacitive touch controller 606 to emulate a real candle that has no visible buttons on the candle body and/or housing. An air moving device 388 or plurality of air moving devices, such as a fan, can be used to force airflow (as indicated by the bold arrows) through the structure and through air inlets 601. In embodiments, airflow through the inlets continues through flow conduits, ducts, tubes, channels, and/or pathways 603 forcing the air out of the housing 202 through air outlet(s) 602. In embodiments, the air outlet(s) 602, which may comprise angled and/or shaped vents, directs the airflow to shape the mist 12 into a vapor plume 218. Air may be pulled through air inlet 600 or plurality of air inlets, which may result in a Venturi effect, creating increased airflow through flow conduits 603. Air outlet(s) 602 may be positioned to create airflow, such as a vortex, to perhaps swirl and/or to further shape and control the mist and vapor plume. Air moving out of the housing through an air outlet or plurality of air outlets, which may be positioned to optimize the desired outcome of emulating a flame, and/or smoke from a burning candle. The air from the air outlet(s) may disperse and/or remove unwanted mist, which may detract from the look of a realistic flame plume. The airflow from the air outlet(s) may be directed at optimum angles to dissipate the resultant dispersed mist to further assist in shaping the mist to emulate a realistic flame plume and flame smoke. Airflow from air outlets may also impact the mist plume to oscillate the mist plume to emulate a dancing flame. Mist may also be shaped within the nozzle, and/or proximal to the nozzle exit, and/or external to the housing, and/or atop the housing/candle body. The vapor mist, or vapor plume tailored by this exemplary artificial flame apparatus can emulate/mimic a realistic flame that may be configured to oscillate, change shape, size, height etc. to move and dance like a fire flame. There are various ways of lighting the plume described in this disclosure, utilizing different techniques to provide power to the light source(s). FIG. 20 provides one approach where the light source(s) is connected to an electrical contact 604 on the nozzle cover 14, and the controller is connected to an electrical mating contact 605 on the reservoir housing 20. When the nozzle cover is mounted to the reservoir housing, the electrical contacts 604 and 605 are mated to complete a circuit allowing an electrical current to flow, connecting the light source(s) to the control unit.

Figure 21:
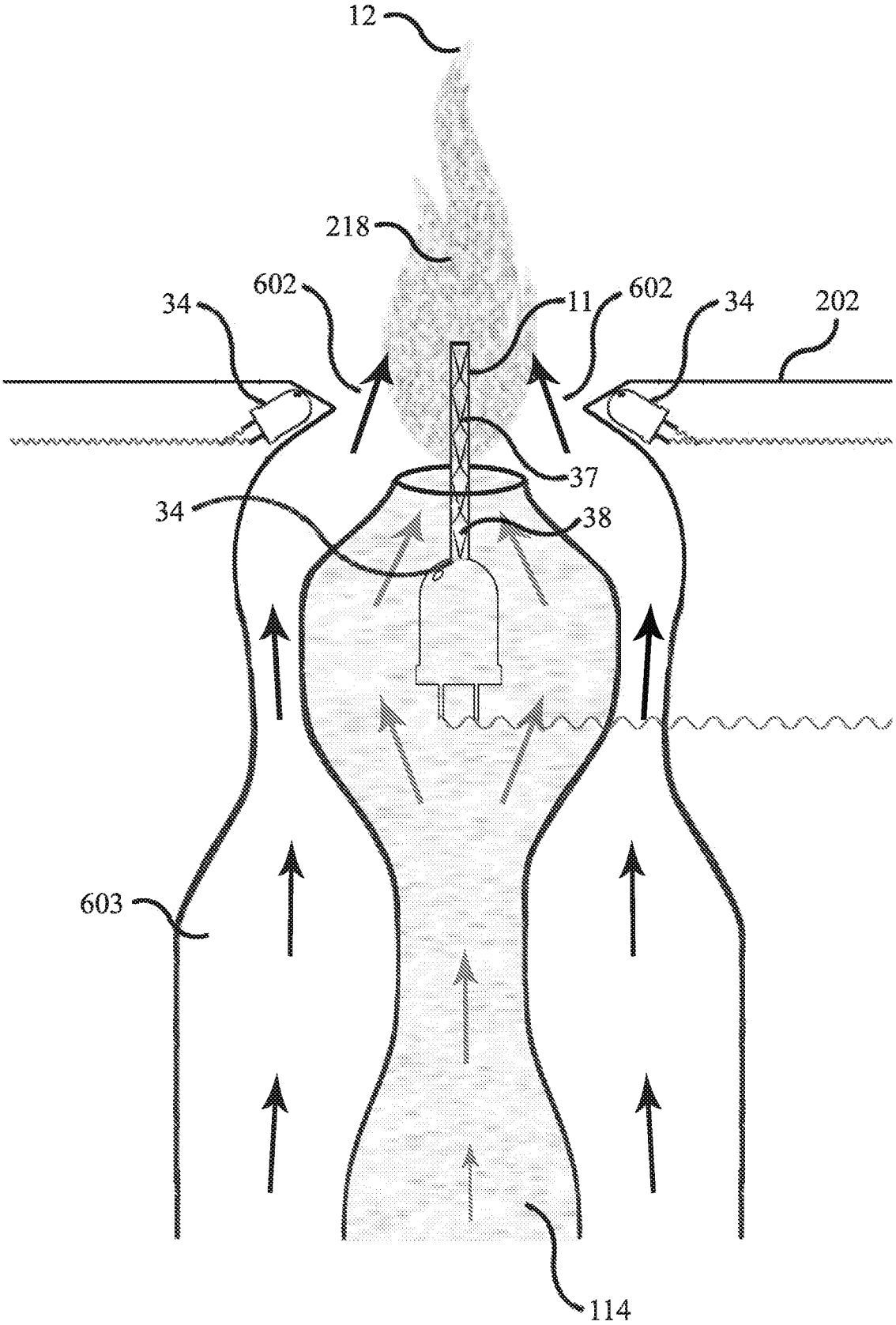
FIG. 21 illustrates an expanded cross-sectional view of the upper portion of an embodiment, which depicts lighting and the use of airflow to further control and shape the mist and vapor plume, among others.

FIG. 21 illustrates an embodiment of an expanded view cross section of the upper portion, which depicts use of airflow, and lighting to further control and shape the mist. Airflow continues through flow conduits, ducts, tubes, channels, and/or pathways 603 forcing the air out of the housing 202 through air outlet(s) 602. The air outlets 602, which may comprise angled and/or shaped vents, directs the airflow to shape the mist 12 into a vapor plume 218. The nozzle cover may comprise various shapes and/or sizes, and constriction points to control the flow of mist 114. In embodiments, the Venturi effect is used to control the flow of mist through the nozzle cover. In embodiments, the Venturi effect is created via the mist flowing through a narrow opening in the nozzle cover. In embodiments, the Bernoulli effect is used to control the flow of mist through the nozzle cover. In embodiments, the Bernoulli effect is created through modulating the speed of the mist as it passes through the nozzle cover. In embodiments, the Bernoulli effect is created through modulating the pressure in the nozzle cover as the mist passes through the nozzle cover.

A light source 34 may be configured to illuminate the vapor plume 218 exiting the housing around (proximal to) the artificial wick 11 and may also illuminate the artificial wick 11. The artificial wick 11 may comprise the light source 34 and may comprise a fiber optic 37 or light tube 38, for example.

The airflow conduit 603 may comprise various shapes and/or sizes, and constriction points to create high pressure and low pressure, incorporating the Venturi effect and/or Bernoulli effect. Air outlet(s) 602 may be positioned to create airflow, such as a vortex, directed to swirl the mist to further shape and control the mist 12 and vapor plume to emulate a flame. Air moving out of the housing through an air outlet or plurality of air outlets, may be directed to optimize the desired outcome of emulating a flame, and/or smoke from a burning candle.

Figure 22:
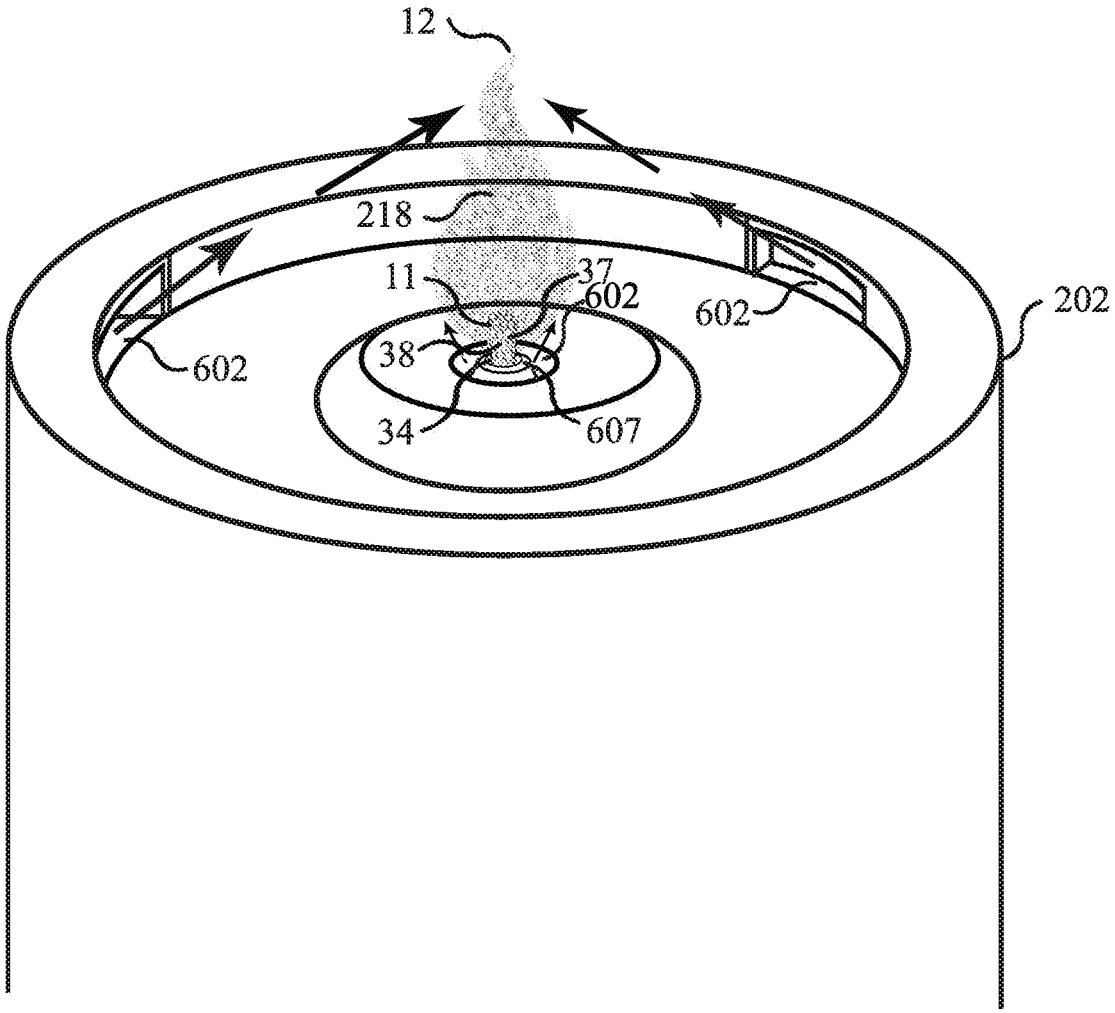
FIG. 22 illustrates a perspective view of the upper portion of an exemplary flame candle, depicting lighting and the use of directed airflow to further control and shape the mist and vapor plume, among others.

FIG. 22 shows a perspective view of the upper part of a candle embodiment similar to FIG. 20, depicting lighting and the use of directed airflow to further control and shape the mist and vapor plume. Directed air is moving out of the housing 202 through an air outlet or plurality of air outlets 602, which may be implemented to control and/or shape the vapor plume to optimize the desired outcome of emulating a flame, and/or burning candle smoke. The air outlet(s) 602, which may comprise angled and/or shaped openings and/or vents, direct the airflow to shape the mist 12 into a vapor plume 218. The air from the air outlet(s) may disperse (knock down), dissipate, and/or remove unwanted mist 12 which may not add to the look of a realistic flame plume. The airflow from the air outlet(s) may be directed to swirl, and/or dissipate the resultant dispersed mist at optimal angles to assist in further shaping the mist to emulate a realistic flame plume and flame smoke. Airflow from air outlets may also blow onto the mist plume exiting the mist outlet 607 to oscillate the mist plume to emulate a dancing flame. A light source 34 may be configured to illuminate the vapor plume 218 exiting the housing around the artificial wick 11 and may also illuminate the artificial wick 11. The artificial wick 11 may comprise the light source 34 and may comprise a fiber optic 37 or light tube 38, for example.

The air moving device, or devices, may be located in an external apparatus, such as a cylindrical clear candle enclosure, lantern enclosure, etc., that may be used to house and/or envelop the candle apparatus to control airflow to the mist plume. Internal or external control of the mist/vapor may be utilized in all other applications, such as fireplaces, fireboxes, etc. through the use of externally mounted air moving device(s), such as fans, and/or vacuums, etc. to control and shape the mist and/or vapor plume(s).

In embodiments, an air moving device is disposed within the housing and positioned to create a flow of air into air inlets through air conduits and exiting air outlets. In embodiments, the air outlets are located above the vapor plume. In embodiments, the air outlets are located below the vapor plume. In embodiments, the air outlets are internal to the housing. In embodiments, the air outlets are external to the housing. In embodiments, the air outlets are positioned atop, outside, within, or inside the housing. In embodiments, the air outlets function to further shape the mist into a flame and/or a plume flame. In embodiments, the air outlets function to create the effect of smoke. In embodiments, the air from the air outlet interacts with the mist from the housing or nozzle. In embodiments, this interaction results in dissemination, removal, and/or repositioning of the mist. In embodiments, this interaction results in shaping the mist to emulate a flame and/or smoke from a burning flame. In embodiments, the air from the air outlet interacts with the mist from the housing or nozzle, which oscillates the mist plume creating the effect of a dancing flame. In embodiments, the air moving devices are fans. In embodiments, the air moving devices are oscillators. In embodiments, the air moving devices are any type of fluidic technology. In embodiments, air movement results from any one more of moving, pushing, or pulling air within the nozzle or wick, or around the nozzle or wick. In embodiments, air is moved around the wick through a plurality of vents on top of the candle, through vents adjacent to the candle. In embodiments, air is moved around the candle, within the candle, or proximal to the candle. In embodiments, the movement of air incorporates the Venturi effect, Bernoulli effect, and/or fluidic technology.

Other uses of the apparatus as described herein, may include biological applications, not necessarily related to simulation of a realistic flame, pyrotechnics, fire pits, torches, car exhaust tubes, education, magic acts, special effects, military/law enforcement/first responders training, etc. This flame technology can be utilized in any application requiring the simulation/replication of a realistic flame. The appended claims set forth novel and inventive aspects of the subject matter described above, but the claims may also encompass additional subject matter not specifically recited in detail. For example, certain features, elements, or aspects may be omitted from the claims if not necessary to distinguish the novel and inventive features from what is already known to a person having ordinary skill in the art. Features, elements, and aspects described herein may also be combined or replaced by alternative features serving the same, equivalent, or similar purpose without departing from the scope of the embodiments described herein.

It will be apparent to those skilled in the art that various modifications, combinations and variations can be made without departing from the scope of the embodiments described herein. Specific embodiments, features and elements described herein may be modified, and/or combined in any suitable manner. Thus, it is intended that the embodiments described herein cover the modifications, combinations and variations of the embodiments described herein.

What is claimed is:

1. A device to produce an artificial flame, comprising:
(i) a liquid;
(ii) a transducer in contact with the liquid;
(iii) one or more mist outlets disposed above the liquid and configured to channel mist produced by the transducer;
(iv) a light source disposed to light the mist as the mist exits the one or more mist outlets
wherein the light source is a LED light source; and
(v) an artificial wick disposed within the one or more mist outlets that further comprises the LED light source.

2. The device of claim 1, further comprising an artificial wick that comprises the light source, wherein the light source is a fiber optic light source.

3. The device of claim 1, further comprising an artificial wick that comprises the light source, wherein the light source comprises a plurality of fiber optic light sources.

4. The device of claim 1, further comprising an artificial wick that comprises the light source, wherein the light source is a light tube.

5. The device of claim 1, wherein the light source comprises a plurality of light sources.

6. The device of claim 1, further comprising an air moving mechanism within the device that shapes the mist.

7. The device of claim 1, further comprising an air moving mechanism external to the device that shapes the mist.

8. The device of claim 1, wherein the mist outlet comprises a shaping nozzle.

9. The device of claim 8, wherein the shaping nozzle is cone shaped.

10. The device of claim 1, further comprising a standing wave tube comprising the one or more mist outlets.

11. An artificial flame apparatus, comprising:
(i) a housing;
(ii) a liquid reservoir within the housing that contains a liquid;
(iii) a transducer having a transducer surface within the housing;
wherein said liquid from the liquid reservoir contacts the transducer surface to produce a mist;
(iv) a controller comprising a drive signal in operable communication with the transducer;
(v) one or more mist outlets disposed above the liquid and configured to channel mist produced by the transducer;
(vi) a light source to illuminate said mist as the mist exits the housing,
wherein the illuminated mist appears as an artificial flame; and
(vii) an air moving mechanism external to the device that shapes the mist.

12. The artificial flame apparatus of claim 11, wherein the light source is a LED light source.

13. The artificial flame apparatus of claim 11, wherein the housing comprises an air moving mechanism within the device that shapes the mist.

14. The artificial flame apparatus of claim 11, further comprising air channels configured to shape the mist into a plume as it exits the one or more mist outlets.

15. The artificial flame apparatus of claim 11, further comprising a shaping nozzle,
wherein the shaping nozzle comprises an opening,
wherein the opening comprises one or more shaping apertures configured to shape the mist.

16. The artificial flame apparatus of claim 11, further comprising a standing wave tube comprising the one or more mist outlets in a fireplace configuration.

17. A method of producing an artificial flame, comprising the steps of:

(i) contacting a liquid with a transducer to produce a mist;
(ii) passing the mist through a mist outlet;
(iii) illuminating the mist with a LED light source; and
(iv) passing the mist through a shaping nozzle that is cone shaped,
wherein the mist is shaped as it passes through the cone shaped shaping nozzle.

18. The method of producing an artificial flame of claim 17, wherein the mist is shaped as it passes through the shaping nozzle through modulating the air pressure in the shaping nozzle.

19. The method of producing an artificial flame of claim 17, wherein the mist is shaped as it passes through the shaping nozzle through modulating the speed of the mist as it passes through the shaping nozzle.

20. The method of producing an artificial flame of claim 17, wherein shaping the mist comprises using directed airflow after the mist passes through the mist outlet.

21. The method of producing an artificial flame of claim 17, wherein the shaping nozzle comprises one or more apertures,
wherein shaping the mist comprises passing the mist through the one or more apertures.

22. The method of producing an artificial flame of claim 17, wherein an air moving device produces a flow of air that passes the mist through the shaping nozzle.

23. An artificial flame apparatus, comprising:
(i) a housing;
(ii) a liquid reservoir within the housing that contains a liquid;
(iii) aromatic oils within the liquid;
(iii) a transducer disposed within the liquid;
(iv) a controller comprising a drive signal in operable communication with the transducer;
(v) one or more mist outlets disposed above the liquid and configured to channel mist produced by the transducer; and
(vi) a light source to illuminate said mist as the mist exits the housing,
wherein the illuminated mist appears as an artificial flame.

24. The artificial flame apparatus of claim 23, further comprising an air moving mechanism.

25. The artificial flame apparatus of claim 24, wherein the air moving mechanism is within the housing.

26. The artificial flame apparatus of claim 24, wherein the air moving mechanism is external to the housing.

27. The artificial flame apparatus of claim 23, further comprising air channels configured to shape the mist into a plume as it exits the one or more mist outlets.

28. A device to produce an artificial flame, comprising:
(i) a liquid;
(ii) a transducer in contact with a liquid;
(iii) one or more mist outlets disposed above the liquid and configured to channel mist produced by the transducer;
(iv) a light source disposed to light the mist as the mist exits the device; and
(v) an air moving mechanism that shapes the mist,
wherein the air moving mechanism is external to the device.

29. The device of claim 28, wherein the air moving mechanism is within the device.

30. A device to produce an artificial flame, comprising:
(i) a liquid;
(ii) a transducer disposed within the liquid;
(iii) one or more mist outlets disposed above the liquid and configured to channel mist produced by the transducer; and
(iv) a light source disposed to light the mist as the mist exits the one or more mist outlets.

31. The device of claim 30, wherein the light source is a LED light source.

32. The device of claim 31, further comprising an artificial wick disposed within the one or more mist outlets that further comprises the LED light source.

33. The device of claim 30, further comprising an artificial wick that comprises the light source, wherein the light source is a fiber optic light source.

34. The device of claim 30, further comprising an artificial wick that comprises the light source, wherein the light source comprises a plurality of fiber optic light sources.

35. The device of claim 30, further comprising an artificial wick that comprises the light source, wherein the light source is a light tube.

36. The device of claim 30, wherein the light source comprises a plurality of light sources.

37. The device of claim 30, further comprising an air moving mechanism within the device that shapes the mist.

38. The device of claim 30, further comprising an air moving mechanism external to the device that shapes the mist.

39. The device of claim 30, wherein the mist outlet comprises a shaping nozzle.

40. The device of claim 39, wherein the shaping nozzle is cone shaped.

41. The device of claim 30, further comprising a standing wave tube comprising the one or more mist outlets.

* * * * *